US012722926B2

(12) United States Patent
Nakai

(10) Patent No.: US 12,722,926 B2
(45) Date of Patent: Sep. 1, 2026

(54) SHEET CONVEYING DEVICE, AUTOMATIC DOCUMENT FEEDER, AND IMAGE FORMING APPARATUS

(71) Applicant: Yusuke Nakai, Kanagawa (JP)

(72) Inventor: Yusuke Nakai, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 249 days.

(21) Appl. No.: 18/440,004

(22) Filed: Feb. 13, 2024

(65) Prior Publication Data

US 2024/0294346 A1 Sep. 5, 2024

(30) Foreign Application Priority Data

Mar. 2, 2023 (JP) ..... 2023-032161

(51) Int. Cl.
*B65H 7/06* (2006.01)

(52) U.S. Cl.
CPC ..... *B65H 7/06* (2013.01); *B65H 2513/52* (2013.01); *B65H 2551/10* (2013.01); *B65H 2553/30* (2013.01); *B65H 2701/1311* (2013.01)

(58) Field of Classification Search
CPC ..... B65H 7/06; B65H 2511/528; B65H 2553/30; B65H 2515/82; B65H 2801/06
USPC ..... 270/58.03, 52.15
See application file for complete search history.

(56) References Cited

U.S. PATENT DOCUMENTS 8,807,561 B2 * 8/2014 Hongo ..... B65H 5/00 271/265.01
8,864,131 B2 * 10/2014 Hongo ..... B65H 3/063 399/21
8,934,115 B2 * 1/2015 Hongo ..... G06K 15/4085 358/1.14

FOREIGN PATENT DOCUMENTS

| | | | |
|---|---|---|---|
| JP | 2003-141306 | A | 5/2003 |
| JP | 2015-041858 | A | 3/2015 |
| JP | 2017-147603 | A | 8/2017 |
| JP | 2019-137549 | A | 8/2019 |
| JP | 2019-167231 | A | 10/2019 |
| JP | 2021-181376 | A | 11/2021 |
| JP | 2023-042119 | A | 3/2023 |
| JP | 2023-158576 | A | 10/2023 |

* cited by examiner

*Primary Examiner* — Leslie A Nicholson, III
(74) *Attorney, Agent, or Firm* — Duft & Bornsen, PC

(57) ABSTRACT

A novel sheet conveying device includes a conveyor, a sound collector, and circuitry. The conveyor conveys a sheet in a sheet conveyance direction. The sound collector collects sound produced by a conveyance of the sheet. The circuitry is to cause the sound collector to collect the sound in an abnormal determination operation, determine whether an abnormal conveyance occurs based on the sound collected by the sound collector in the abnormal determination operation, cause the conveyor to convey the sheet at a first speed in the sheet conveyance direction in a normal conveyance operation, and cause the conveyor to convey the sheet at a second speed slower than the first speed in the sheet conveyance direction in the abnormal determination operation.

18 Claims, 8 Drawing Sheets

SHEET CONVEYING DEVICE, AUTOMATIC DOCUMENT FEEDER, AND IMAGE FORMING APPARATUS

CROSS-REFERENCE TO RELATED APPLICATION

This patent application is based on and claims priority pursuant to 35 U.S.C. § 119 (a) to Japanese Patent Application No. 2023-032161, filed on Mar. 2, 2023, in the Japan Patent Office, the entire disclosure of which is hereby incorporated by reference herein.

BACKGROUND

Technical Field

Embodiments of the present disclosure relate to a sheet conveying device, an automatic document feeder, and an image forming apparatus.

Background Art

Typical sheet conveying devices include a conveyor to convey a sheet, a sound collector to collect sound generated when the sheet is conveyed, an abnormal conveyance determination unit to determine whether abnormal conveyance occurs based on the sound collected by the sound collector.

SUMMARY

Embodiments of the present disclosure described herein provide a novel sheet conveying device including a conveyor, a sound collector, and circuitry. The conveyor conveys a sheet in a sheet conveyance direction. The sound collector collects sound produced by a conveyance of the sheet. The circuitry is to cause the sound collector to collect the sound in an abnormal determination operation, determine whether an abnormal conveyance occurs based on the sound collected by the sound collector in the abnormal determination operation, cause the conveyor to convey the sheet at a first speed in the sheet conveyance direction in a normal conveyance operation, and cause the conveyor to convey the sheet at a second speed slower than the first speed in the sheet conveyance direction in the abnormal determination operation.

Further, embodiments of the present disclosure described herein provide an automatic document feeder including the above-described sheet conveying device that the above-described sheet conveying device to convey a document sheet, and an image forming device to form an image based on image data of the sheet, on a transfer medium.

Further, embodiments of the present disclosure described herein provide an automatic document feeder including the above-described sheet conveying device to automatically convey an original document as the sheet to an image reader.

Further, embodiments of the present disclosure described herein provide an image forming apparatus including the above-described automatic document feeder and an image forming device to form an image on a transfer medium.

BRIEF DESCRIPTION OF THE SEVERAL VIEWS OF THE DRAWINGS

A more complete appreciation of embodiments of the present disclosure and many of the attendant advantages and features thereof can be readily obtained and understood from the following detailed description with reference to the accompanying drawings, wherein.

Figure 1:
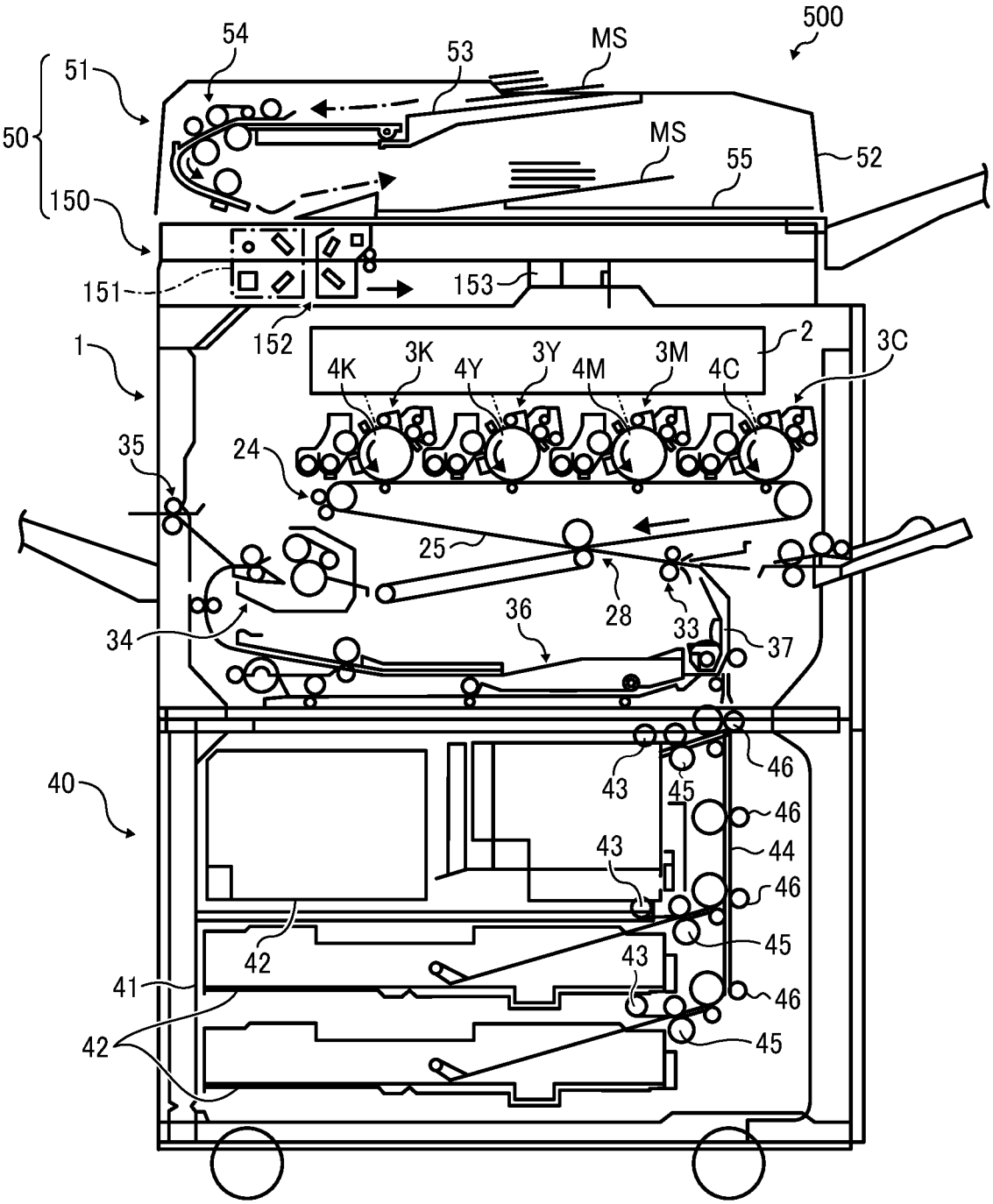
FIG. 1 is a schematic diagram illustrating a configuration of a copier as an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION

It will be understood that if an element or layer is referred to as being "on," "against," "connected to" or "coupled to" another element or layer, then it can be directly on, against, connected or coupled to the other element or layer, or intervening elements or layers may be present. In contrast, if an element is referred to as being "directly on," "directly connected to" or "directly coupled to" another element or layer, then there are no intervening elements or layers present. As used herein, the term "connected/coupled" includes both direct connections and connections in which there are one or more intermediate connecting elements. Like numbers refer to like elements throughout. As used herein, the term "and/or" includes any and all combinations of one or more of the associated listed items.

Spatially relative terms, such as "beneath," "below," "lower," "above," "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

The terminology used herein is for describing particular embodiments and examples and is not intended to be limiting of exemplary embodiments of this disclosure. As used herein, the singular forms "a," "an," and "the" are intended to include the plural forms as well, unless the context clearly indicates otherwise. It will be further understood that the terms "includes" and/or "including," when used in this specification, specify the presence of stated features, integers, steps, operations, elements, and/or components, but do not preclude the presence or addition of one or more other features, integers, steps, operations, elements, components, and/or groups thereof.

Referring now to the drawings, embodiments of the present disclosure are described below. As used herein, the singular forms "a," "an," and "the" are intended to include the plural forms as well, unless the context clearly indicates otherwise.

Image Forming Process in Image Forming Apparatus

A description is given of an image forming apparatus according to an embodiment of the present disclosure with reference to the drawings attached.

Elements (for example, mechanical parts and components) having the same functions and shapes are denoted by the same reference numerals throughout the specification and redundant descriptions are omitted.

In the above description, the term "image forming apparatus" means an apparatus that performs image formation by making image formation and ink adhere to a sheet that is a recording medium to record an image. Image-forming substance includes toner and ink as developer but is not limited to toner and ink. Further, the term "image formation" indicates an action for providing (i.e., printing) not only an image having meanings such as texts and figures on a recording medium but also an image having no meaning such as patterns on a recording medium. The term "sheet" is not limited to paper (paper sheet) and includes, for example, an overhead projector (OHP) sheet, and cloth, and indicates a medium or a document to which a developer or ink can be made to adhere. In addition, the term "sheet" is not limited to a flexible sheet such as a plain paper but also is applicable to a rigid plate-shaped sheet and a relatively thick sheet such as thick paper, post card, envelope, thin paper, coated paper, art paper, and tracing paper. Further in the following embodiments, the "sheet" indicates a paper, the "toner" indicates developer, and size (dimension), material, shape, and relative positions used to describe each of the components and units are examples, and the scope of this disclosure is not limited thereto unless otherwise specified.

Descriptions below are given of a sheet conveying device, an automatic document feeder, and an image forming apparatus, according to embodiments of the present disclosure, with reference to the accompanying drawings. It is to be understood that those skilled in the art can easily modify and change the present disclosure within the scope of the appended claims to form other embodiments, and these modifications and changes are included in the scope of the appended claims. The following description is an example of the best mode of the present disclosure, and does not limit the scope of the claims.

Descriptions are given of an electrophotographic image forming apparatus for forming images by electrophotography. In the present disclosure, the electrophotographic image forming apparatus is referred to as an electrophotographic copier (or simply, a copier). A description is now given of the basic configuration of a copier as an image forming apparatus according to the present embodiment.

FIG. 1 is a diagram illustrating a schematic configuration of a copier 500 serving as an image forming apparatus according to the present embodiment.

The copier 500 includes an image forming device 1, a blank sheet feeding device 40, and a document reading device 50. The document reading device 50 includes a scanner 150 fixedly mounted on the image forming device 1 and an automatic document feeder (ADF) 51 serving as a sheet conveying device and a document feeder supported by the scanner 150.

The blank sheet feeding device 40 includes a sheet bank 41, sheet feed rollers 43, and sheet separation roller pairs 45. The sheet bank 41 includes multiple sheet trays 42 (three sheet trays 42 in the present embodiment) disposed in a multistage manner. Each of the sheet feed rollers 43 picks up a transfer sheet serving as a recording medium from the corresponding sheet trays 42. Each of the sheet separation roller pairs 45 separates the transfer sheet from the corresponding sheet tray 42 and feeds the transfer sheet to a sheet conveyance passage 44. The blank sheet feeding device 40 further includes multiple sheet conveyance rollers 46. Each of the multiple sheet conveyance rollers 46 conveys the transfer sheet toward a sheet conveyance passage 37. Thus, the blank sheet feeding device 40 feeds the transfer sheet stacked on the corresponding sheet tray 42 to the sheet conveyance passage 37 in the image forming device 1.

Figure 2:
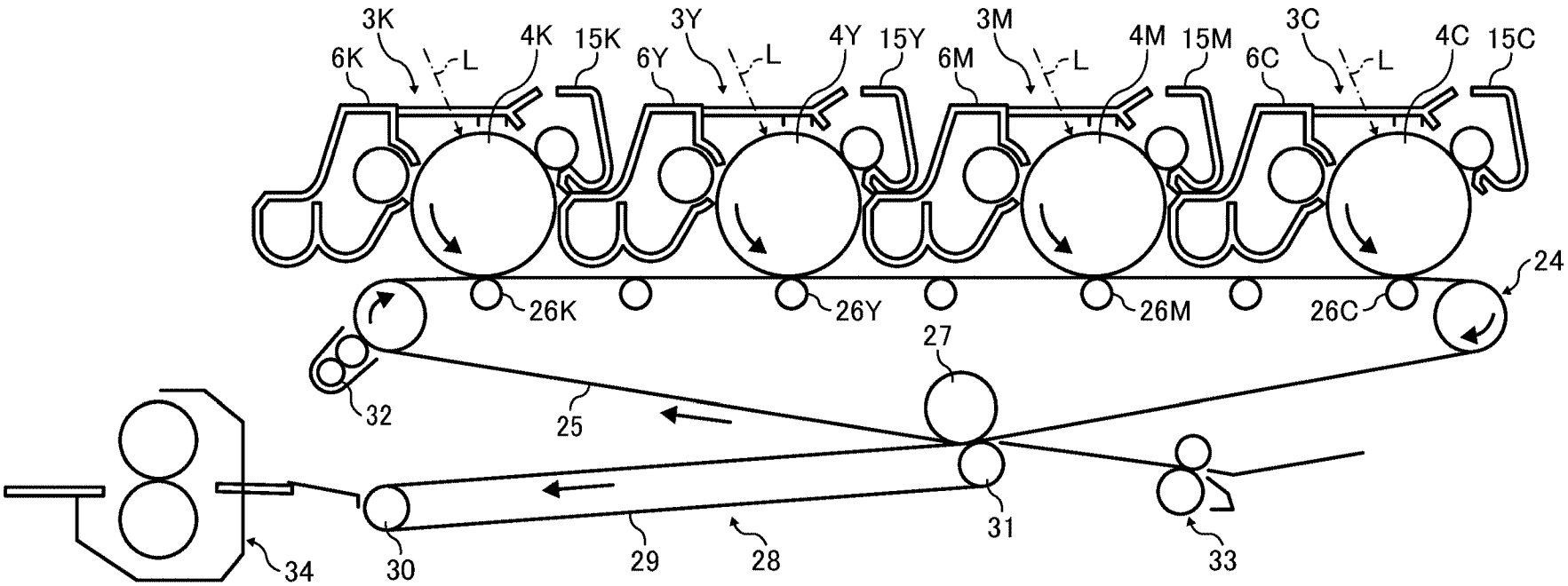
FIG. 2 is a partially enlarged view of a part of an inner configuration of an image forming device of the copier of FIG. 1.

FIG. 2 is a diagram illustrating a partially enlarged configuration of the image forming device 1 included in the copier 500 of FIG. 1.

As illustrated in FIG. 2, the image forming device 1 includes an optical writing device 2, four process units 3K, 3Y, 3M, and 3C, and a transfer unit 24. The process units 3K, 3Y, 3M, and 3C form a black toner image, a yellow toner image, a magenta toner image, and a cyan toner image, respectively. The image forming device 1 further includes a sheet conveying unit 28, a registration roller pair 33, a fixing device 34, a switchback device 36, and the sheet conveyance passage 37. The optical writing device 2 includes a light source such as a laser diode and a light emitting diode (LED). The light source is disposed in the optical writing device 2. By driving the light source in the optical writing device 2, laser lights L are emitted toward four drum-shaped photoconductors 4K, 4Y, 4M, and 4C to irradiate respective surfaces of the drum-shaped photoconductors 4K, 4Y, 4M, and 4C. Due to this irradiation, electrostatic latent images of respective single colors are formed on the surfaces of the photoconductors 4K, 4Y, 4M, and 4C, which will be developed to visible toner images via a given development process. Suffixes K, Y, M, and C denote colors black, yellow, magenta, and cyan, respectively. To simplify the description, these suffixes may be omitted unless necessary in the following description.

The process units 3K, 3Y, 3M, and 3C also include respective image forming units disposed around each of the photoconductors 4K, 4Y, 4M, and 4C as a single unit supported by a common support member, respectively. The process units 3K, 3Y, 3M, and 3C are detachably attached to the image forming device 1 of the copier 500. The process unit 3 (i.e., the process units 3K, 3Y, 3M, and 3C) includes the photoconductor 4 (i.e., the photoconductors 4K, 4Y, 4M, and 4C) and a developing device 6 (i.e., developing devices 6K, 6Y, 6M, and 6C) that develops an electrostatic latent image formed on a surface of the photoconductor 4 into a visible toner image. The process unit 3 further include a drum cleaning device 15 (i.e., drum cleaning devices 15K, 15Y, 15M, and 15C). The drum cleaning device 15 removes transfer residual toner remaining on the surface of the drum cleaning device 15 after the photoconductor 4 has passed the primary transfer nip region for the photoconductor 4 and cleans the surface of the photoconductor 4. The copier 500 is a tandem image forming apparatus in which the four process units 3K, 3Y, 3M, and 3C are aligned in a direction of movement of an intermediate transfer belt 25 as an endless loop.

Figure 3:
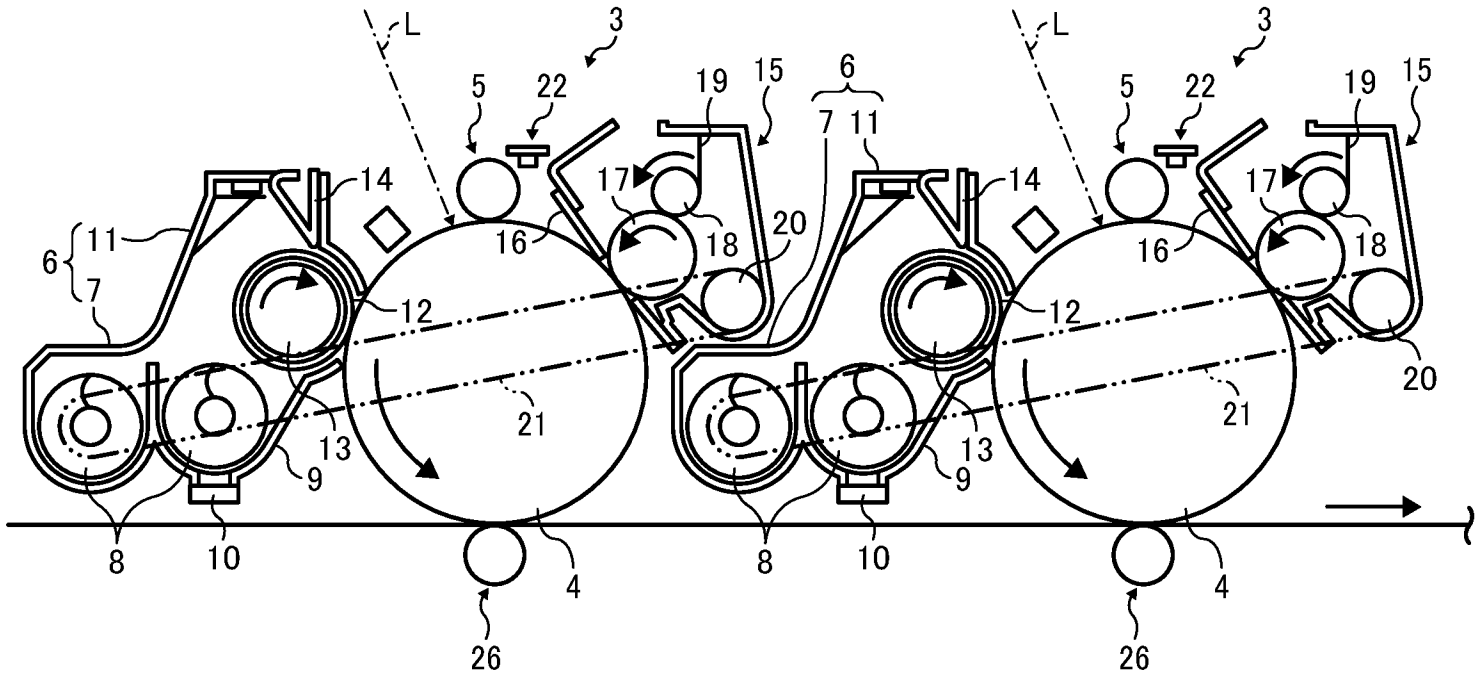
FIG. 3 is an enlarged view of a part of a tandem unit including four process units of the image forming device of FIG. 2.

FIG. 3 is an enlarged view of a part of a tandem portion including the four process units 3K, 3Y, 3M, and 3C.

Since the process units 3K, 3Y, 3M, and 3C have respective configurations substantially identical to each other except the toner colors, the process units 3K, 3Y, 3M, and 3C are also described without suffixes indicating the toner colors, which are K, Y, M, and C in FIG. 3. For example, the process units 3K, 3Y, 3M, and 3C are hereinafter referred to as a "process unit 3" in a single form occasionally. The process unit 3 (i.e., the process units 3K, 3Y, 3M, and 3C) includes the photoconductor 4 (i.e., the photoconductors 4K, 4Y, 4M, and 4C), and a charging device 5, the developing device 6 (i.e., the developing devices 6K, 6Y, 6M, and 6C), the drum cleaning device 15 (i.e., the drum cleaning devices 15K, 15Y, 15M, and 15C), and an electric discharging lamp 22 around the photoconductor 4.

The photoconductor 4 is manufactured by a hollow tube made of aluminum, for example, with a drum shape covered by an organic photoconductive layer having photosensitivity. Each of the photoconductors 3Y, 3M, 3C, and 3K may include an endless belt.

The developing device 6 develops an electrostatic latent image into a visible toner image by a two-component developer including magnetic carrier particles and non-magnetic toner. The two-component developer is now referred to as a "developer". The developing device 6 includes an agitating portion 7 and a development portion 11. The agitating portion 7 stirs the two-component developer accommodated therein and conveys the two-component developer to a development sleeve 12. The development portion 11 supplies the non-magnetic toner, which is included in the two-component developer and held by the development sleeve 12, to the photoconductor 4.

The agitating portion 7 is located at a position lower than the development portion 11 and includes two screw, a partition, a development case 9, and a toner concentration sensor 10. The two transfer screws 8 are disposed in parallel to each other. The partition is disposed between the two transfer screws 8. The development case 9 has an opening or a slot to face the photoconductor 4. The toner concentration sensor 10 is disposed on the bottom of the development case 9.

The development portion 11 includes the development sleeve 12, a magnetic roller 13, and a doctor blade 14. The development sleeve 12 faces the photoconductor 4 through the opening (or the slot) of the development case 9. The magnetic roller 13 is fixedly or unrotatably disposed inside the development sleeve 12. The doctor blade 14 is disposed adjacent to the development sleeve 12 and the leading end of the doctor blade 14 is disposed close to the development sleeve 12. The development sleeve 12 has a non-magnetic, rotatable tubular body. The magnetic roller 13 has multiple magnetic poles arranged in the order in a rotation direction of the development sleeve 12, starting from an opposed position to the doctor blade 14. Each of these magnetic poles applies a magnetic force at a predetermined position in the rotation direction of the development sleeve 12, with respect to the two-component developer supplied on the development sleeve 12. With this action of the magnetic roller 13, the two-component developer that is conveyed from the agitating portion 7 is attracted and attached to the surface of the development sleeve 12 and a magnetic brush of toner is formed along the lines of the magnetic force on the surface of the development sleeve 12.

In accordance with rotation of the development sleeve 12, the magnetic brush is regulated to have an appropriate layer thickness when passing by the opposed position to the doctor blade 14. Then, the magnetic brush is moved to a development region facing the photoconductor 4. Due to a difference of potentials between a development bias that is applied to the development sleeve 12 and an electrostatic latent image formed on the surface of the photoconductor 4, the toner is transferred onto the electrostatic latent image, so that the electrostatic latent image is developed into a visible toner image. Further, after returning into the development portion 11 again along with the rotation of the development sleeve 12 then leaving from the surface of the development sleeve 12 due to repulsion of the magnetic field formed between the magnetic poles of the magnetic roller 13, the two-component developer in a form of the magnetic brush is returned to the agitating portion 7. An appropriate amount of toner is supplied to the two-component developer in the agitating portion 7 based on a result or results detected by the toner concentration sensor 10. Alternative to the two-component developer, the developing device 6 according to the present embodiment may employ one-component developer that does not include magnetic carriers.

In the present embodiment, the drum cleaning device 15 employs a method of pressing a cleaning blade 16 made of a polyurethane rubber pressed against the photoconductor 4. However, in some embodiments, any other suitable cleaning method may be used.

The fur brush 17 according to the present embodiment is provided in order to increase cleanability. The fur brush 17 is a conductive member and the outer circumferential surface of the fur brush 17 slidably contacts the photoconductor 4. The fur brush 17 according to the present embodiment is rotatable in a direction indicated by arrow in FIG. 4. The fur brush 17 also functions as an applier that scrapes a solid lubricant to obtain fine powder of lubricant and applies the scraped fine powder to the surface of the photoconductor 4. The electric field roller 18 is a metallic member that applies a bias to the fur brush 17. The electric field roller 18 is disposed rotatably in a direction indicated by arrow in FIG. 3. The scraper 19 has a leading end that is pressed against the electric field roller 18. The toner removed from the photoconductor 4 and attached to the fur brush 17 is transferred onto the electric field roller 18 that contacts the fur brush 17 in a counter direction to be applied with a bias while the electric field roller 18 is rotating. After being scraped and removed from the electric field roller 18 by the scraper 19, the toner falls onto the collection screw 20. The collection screw 20 conveys the toner collected from the surface of the photoconductor 4 toward an end portion of the drum cleaning device 15 in a direction perpendicular to the drawing sheet, and transfers the collected toner to an external toner recycling transfer device 21. The external toner recycling transfer device 21 sends the collected toner to the developing device 6 for recycling.

The electric discharging lamp 22 removes residual electric charge remaining on the surface of the photoconductor 4 by photo irradiation. After such residual electric charge is removed, the electrically discharged surface of the photoconductor 4 is uniformly charged by the charging device 5 again and then optically irradiated by the optical writing unit 2. In the copier 500 serving as an image forming apparatus according to the present embodiment, the charging device 5 is a charging roller that is applied with charging bias and rotates while contacting the photoconductor 4. However, in some embodiments, the charging device 5 may be a scorotron charger that performs a charging process on the photoconductor 4 in non-contact with the photoconductor 4.

According to the above-described operations with the configuration illustrated in FIG. 2, black (K), yellow (Y), magenta (M), and cyan (C) toner images are formed on the photoconductors 4K, 4Y, 4M, and 4C of the process units 3K, 3Y, 3M, and 3C, respectively.

The transfer unit 24 is disposed below the process units 3K, 3Y, 3M, and 3C, as illustrated in FIG. 2. The transfer unit 24 endlessly moves the intermediate transfer belt 25 in the clockwise direction in FIG. 2 while the intermediate transfer belt 25 is stretched by and would around multiple rollers and is in contact with the photoconductors 4K, 4Y, 4M, and 4C. By so doing, respective primary transfer nip regions for forming black, yellow, magenta, and cyan images are formed between the photoconductors 4K, 4Y, 4M, and 4C and the intermediate transfer belt 25 in contact with each other. In proximity to each of the primary transfer nip regions for black, yellow, magenta, and cyan images, the primary transfer rollers 26 (i.e., the primary transfer rollers 26K, 26Y, 26M, and 26C) are disposed in contact with the inner loop of the intermediate transfer belt 25 to press the intermediate transfer belt 25 against the photoconductors 4 (i.e., the photoconductors 4K, 4Y, 4M, and 4C), respectively. A primary transfer bias is applied by respective transfer bias power supplies to the primary transfer rollers 26K, 26Y, 26M, and 26C. Consequently, respective primary transfer electric fields are generated in the primary transfer nip regions to electrostatically transfer respective toner images formed on the photoconductors 4K, 4Y, 4M, and 4C onto the intermediate transfer belt 25. As the intermediate transfer belt 25 passes through the primary transfer nip regions along the endless rotation in the clockwise direction in FIG. 2, the black, yellow, magenta, and cyan toner images are sequentially transferred at the primary transfer nip regions and overlaid onto an outer circumferential surface of the intermediate transfer belt 25. Due to the primary transfer of the toner images, a four-color composite toner image (referred to as a four-color toner image) is formed on the surface of the intermediate transfer belt 25.

The sheet conveying unit 28 is disposed below the transfer unit 24 in FIG. 2. The sheet conveying unit 28 includes a sheet transfer belt 29, a sheet transfer belt drive roller 30, and a secondary transfer roller 31. The sheet transfer belt 29 is an endless belt that is wound around the sheet transfer belt drive roller 30 and the secondary transfer roller 31 and rotates in a direction indicated by arrow in FIG. 2. As illustrated in FIG. 2, the intermediate transfer belt 25 and the sheet transfer belt 29 are sandwiched between the secondary transfer roller 31 and a lower tension roller 27 of the transfer unit 24. According to this configuration, a secondary transfer nip region is formed between the surface of the intermediate transfer belt 25 and the surface of the sheet transfer belt 29 contacting with each other. A secondary transfer bias is applied by a transfer bias power source to the secondary transfer roller 31. On the other hand, the lower tension roller 27 of the transfer unit 24 is electrically grounded. By so doing, a secondary transfer electric field is formed in the secondary transfer nip region.

The registration roller pair 33 is disposed on the right side of the secondary transfer nip region in FIG. 2. The registration roller pair 33 nips the transfer sheet P between the rollers and conveys the transfer sheet P to the secondary transfer nip region in synchronization with arrival of the four-color toner image formed on the intermediate transfer belt 25 so as to further convey the transfer sheet P toward the secondary transfer nip region. In the secondary transfer nip region, the four-color toner image formed on the intermediate transfer belt 25 is transferred onto the transfer sheet P due to the secondary transfer electric field and a nip pressure. At this time, the four-color toner image is combined with white color of the transfer sheet P to make a full-color toner image. After passing through the secondary transfer nip region, the transfer sheet P having the full-color toner image on the surface is separated from the intermediate transfer belt 25. Then, while being held on the surface of the sheet transfer belt 29, the transfer sheet P is conveyed to the fixing device 34 along with endless rotation of the sheet transfer belt 29 in the direction indicated by arrow in FIG. 2.

Residual toner that has not been transferred onto the transfer sheet P in the secondary transfer nip region remains on the surface of the intermediate transfer belt 25 after the intermediate transfer belt 25 has passed through the secondary transfer nip region. The residual toner is scraped and removed from the surface of the intermediate transfer belt 25 by a belt cleaning device 32 that is disposed in contact with the surface of the intermediate transfer belt 25.

The transfer sheet P is conveyed to the fixing device 34. The fixing device 34 fixes the full-color toner image to the transfer sheet P by application of heat and pressure. Then, the transfer sheet P is conveyed from the fixing device 34 to the sheet ejection roller pair 35 (see FIG. 1) to be ejected to the outside of the copier 500.

As illustrated in FIG. 1, the switchback device 36 is disposed below the sheet conveying unit 28 and the fixing device 34. As a result of the above-described operation, after the image fixing operation is performed on one side or the surface of the transfer sheet P, a separator switches the direction of conveyance of the transfer sheet P. Specifically, the direction of conveyance of the transfer sheet P is switched to a passage to a transfer reversal device by the separation member. When the transfer sheet P is conveyed to the transfer reversal device, the transfer sheet P is reversed to enter the secondary transfer nip region of the copier 500 again. In the copier 500, a toner image is secondarily transferred onto the other side or a back face of the transfer sheet P so that the secondary transfer process and the fixing process are executed. Then, the transfer sheet P is ejected onto the ejection tray.

Figure 4:
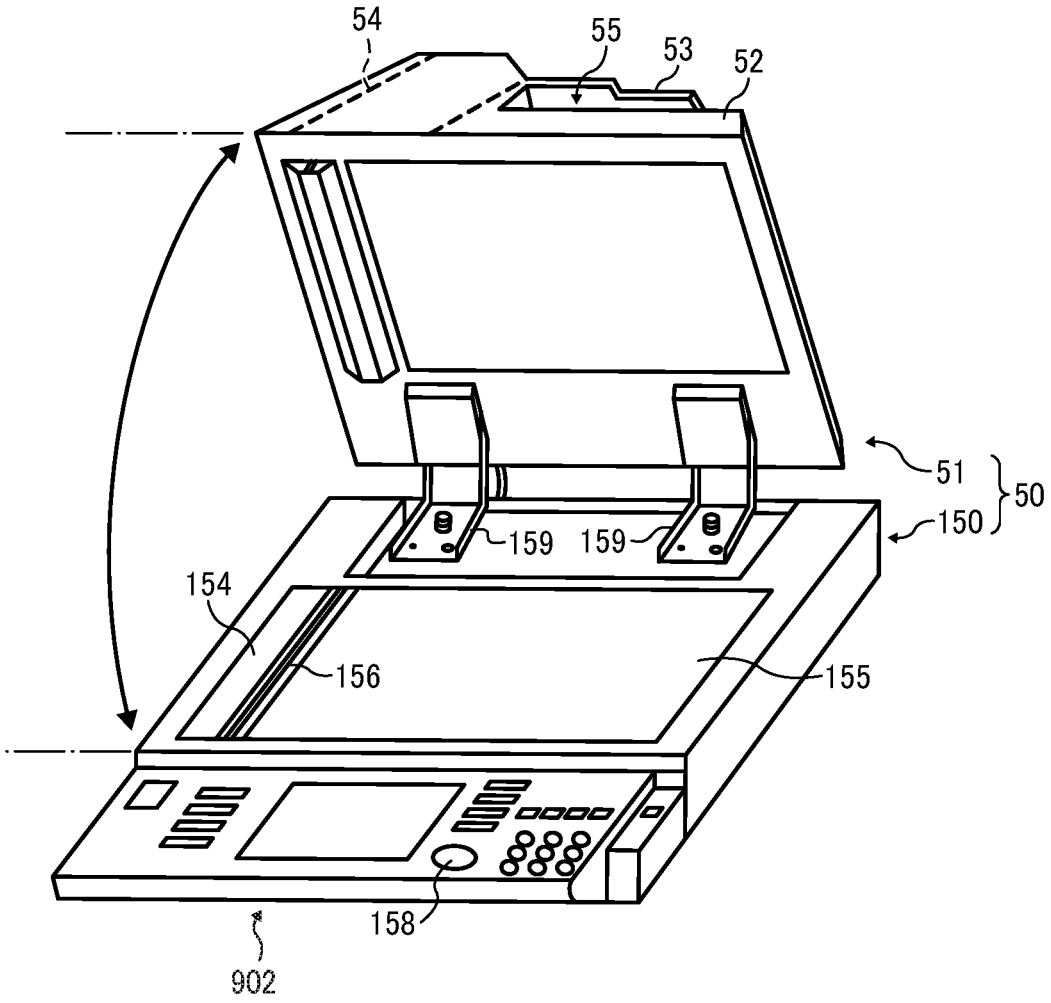
FIG. 4 is a perspective view of a scanner and an automatic document feeder of the copier of FIG. 1.

FIG. 4 is a perspective view of the scanner 150 and the ADF 51 of the copier of FIG. 1.

The scanner 150 is fixedly mounted on the image forming device 1 and includes a first fixed reading unit 151 serving as a first face reader, and a movable scanning unit 152 serving as a first face reader.

The movable scanning unit 152 serving as a first face reader is disposed immediately below a second exposure glass 155 (see FIG. 4) that is fixedly mounted on the upper wall of the casing of the scanner 150, so that the second exposure glass 155 contacts the original document MS. The movable scanning unit 152 can move optical components such as a light source and reflection mirrors in left and right directions in FIG. 1. In the course of moving the optical components from left to right in FIG. 1, the light source emits the light. After a surface of the original document MS placed on the second exposure glass 155 reflects light, the reflected light is further reflected on multiple reflection mirrors until an image reading sensor 153 that is fixed to the scanner 150 receives the reflected light.

The first fixed reading unit 151 serving as a first face reader is disposed immediately below a first exposure glass 154 (see FIG. 4) that is fixedly mounted on the upper wall of the casing of the scanner 150, so that the first exposure glass 154 contacts the original document MS. When the original document MS that is conveyed by the ADF 51 that will be described below passes over the first exposure glass 154, the light source emits light. After a document face of the original document MS sequentially reflects the light emitted from the light source, the reflected light is further reflected on multiple reflection mirrors until the image reading sensor 153 receives the reflected light. By so doing, the first face of the original document MS is scanned without moving the optical components such as the light source and the multiple reflection mirrors.

The ADF 51 of the document reading device 50 further includes a contact image sensor 95 (see FIG. 5) that reads the second face of the original document MS. The contact image sensor 95 is described below.

The ADF 51 that is disposed on the scanner 150 includes a body cover 52, a document loading tray 53, a document conveyance unit 54, and a document stacker 55. The body cover 52 holds and supports the document loading tray 53, the document conveyance unit 54, and the document stacker 55. The document loading tray 53 loads the original document MS to be read. The document conveyance unit 54 conveys the original document MS. The document stacker 55 receives and stacks the original document MS after the original document MS is read. As illustrated in FIG. 4, hinges 159 each being fixed to the scanner 150 rotatably support the scanner in the upward and downward directions. With the rotation of the ADF 51 in the upward and downward directions, the ADF 51 works as an opening door, so that the first exposure glass 154 and the second exposure glass 155 on the upper face of the scanner 150 are exposed while the ADF 51 is open.

In a case of the one-sided bound documents such as a book of a document bundle bounded on one-side, the original documents MS cannot be separated one by one. For this reason, the original documents MS cannot be conveyed by the ADF 51. When reading the one-sided bound documents, the ADF 51 is opened as illustrated in FIG. 4. After the ADF 51 is opened as described above, the one-sided bound documents are placed on the second exposure glass 155 with a page to be read facing down. Then, the scanner 150 causes the movable scanning unit 152 to read the image on the page of the one-sided bound documents placed facedown.

On the other hand, when the original documents MS are in a form of a document bundle of simply accumulated individual original documents MS, the original documents MS are sequentially read by the first fixed reading unit 151 in the scanner 150 or the contact image sensor 95 in the ADF 51 while the ADF 51 automatically conveys the original documents MS one by one. In this case, a copy start button is pressed after the bundle of original documents is positioned on the document loading tray 53 of the ADF 51. Then, the ADF 51 starts conveyance of the original documents MS that is a bundle of original documents stacked on the document loading tray 53 to convey the original documents MS sequentially from top of the bundle of original documents MS to the document stacker 55. In the course of this conveyance of the original documents MS, immediately after the original document MS is reversed, the original document MS is caused to pass immediately above the first fixed reading unit 151 of the scanner 150.

At this time, the image on the first face of the original document MS is read by the first fixed reading unit 151 of the scanner 150.

Figure 5:
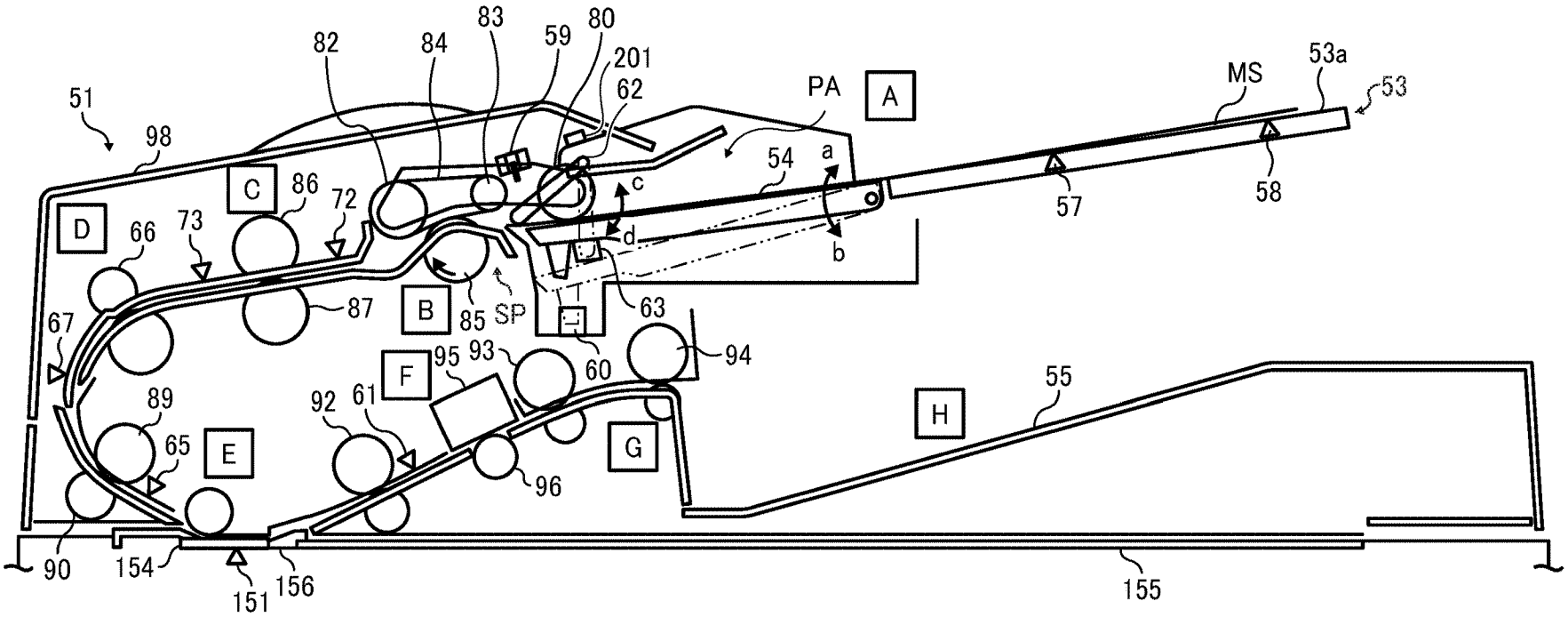
FIG. 5 is an enlarged view of the automatic document feeder and the upper part of the scanner of FIG. 4.

FIG. 5 is a diagram illustrating an enlarged part of the configuration of the ADF 51 and the upper part of the scanner 150.

Figure 6:
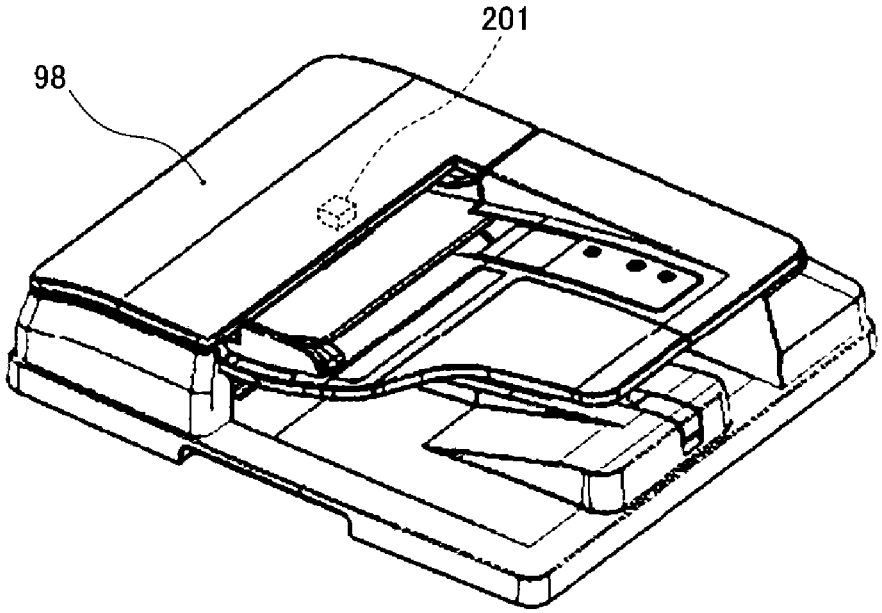
FIG. 6 is a perspective view of an automatic document feeder.

FIG. 6 is a perspective view of the ADF 51.

Figure 7:
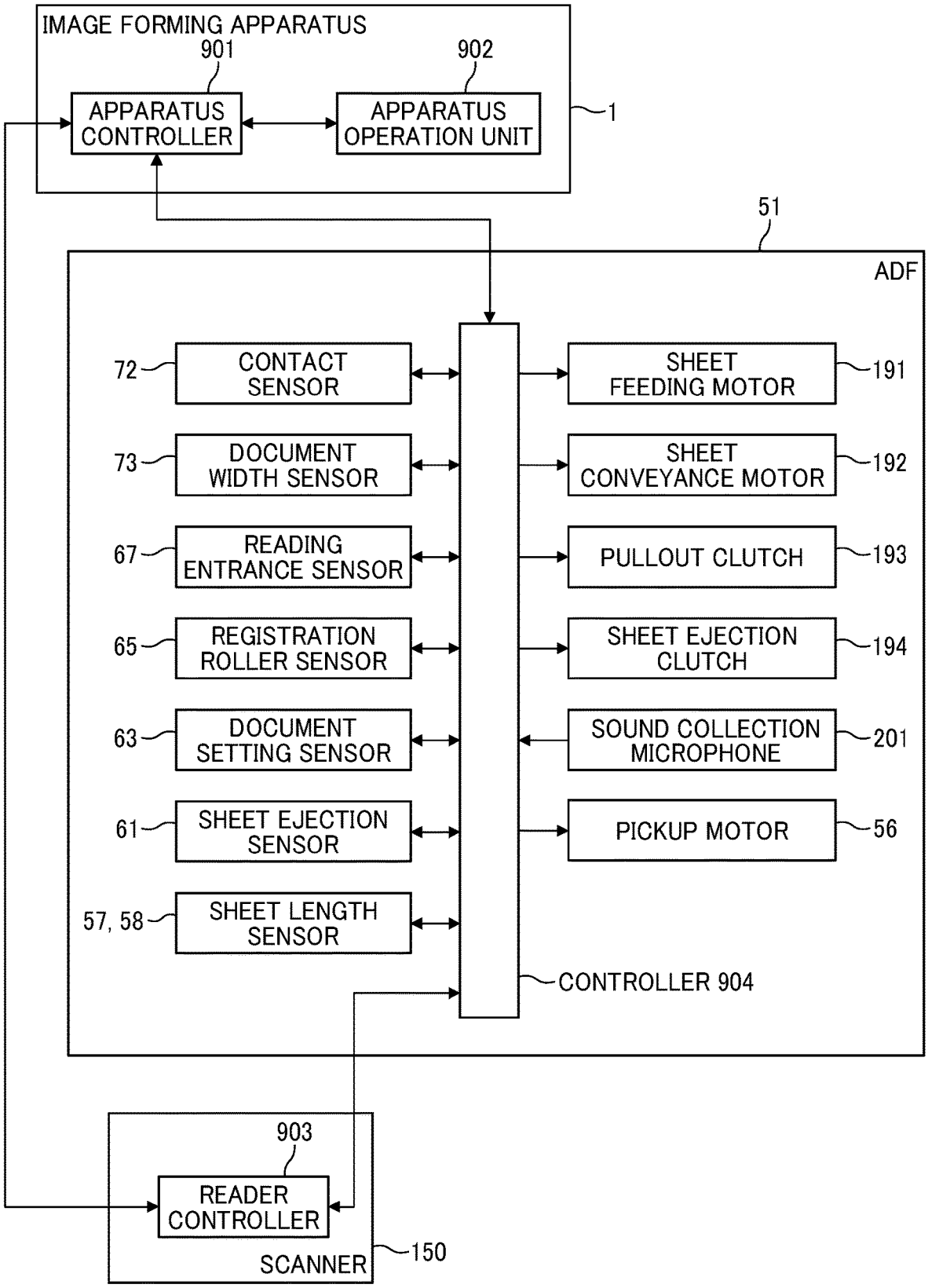
FIG. 7 is a block diagram illustrating a part of an electric circuit of the automatic document feeder and the scanner of FIG. 4.

FIG. 7 is a block diagram illustrating a part of an electric circuit of the ADF 51 and the scanner 150.

As illustrated in FIG. 5, the ADF 51 according to the present embodiment includes a document setting part A, a document separating and feeding part B, a registration part C, a document turning part D, a first reading and conveying part E, a second reading and conveying part F, a document ejecting part G, and a document stacking part H.

As illustrated in FIG. 7, the ADF 51 includes an ADF controller 904 provided with, for example, an application specific integrated circuit (ASIC) to control various components and sensors in the ADF 51. The ADF controller 904 is connected to a registration sensor 65, a document set sensor 63, a document ejection sensor 61, a document contact sensor 72, a document width sensor 73, a scan entrance sensor 67, a first document length sensor 57, and a second document length sensor 58, as illustrated in FIG. 6. The ADF controller 904 is further connected to, for example, a sheet feeding motor 191, a sheet conveyance motor 192, a pullout clutch 193, a sheet ejection clutch 194, and a pickup motor 56. The ADF controller 904 is further connected to a sound collection microphone 201 serving as a sound collector. The sound collection microphone 201 collects sound occurring when the original document MS is conveyed.

As illustrated in FIG. 7, the scanner 150 includes a scanner controller 903 including, for example, a central processing unit (CPU) and a random access memory (RAM). With the scanner controller 903, various components and sensors in the scanner 150 can be controlled. Further, the scanner controller 903 is connected to the ADF controller 904 of the ADF 51 via the interface (I/F). The scanner controller 903 may indirectly control the various components and sensors in the ADF 51 via the ADF controller 904.

In FIG. 5, the document setting part A has the document loading tray 53 on which a bundle of original documents MS is positioned. The document separating and feeding part B separates the original documents MS one by one from the bundle of original documents MS set on the document loading tray 53 in the document setting part A to feed the separated original document MS. Further, in the registration part C, the original document MS fed from the document separating and conveying part B temporarily contacts the pullout driven roller 86 and the pullout drive roller 87 to be aligned and fed again. The document turning part D has a conveyance passage curved in a C-shape, and turns the original document MS to be conveyed in the curved conveyance passage so as to reverse the original document MS upside down while turning the original document MS. Then, in the first reading and conveying part E, the first fixed reading unit 151 disposed in the scanner 150 below the first exposure glass 154 as illustrated in FIG. 1 reads the first face of the original document MS while the original document MS is being conveyed on the first exposure glass 154. Further, in the second reading and conveying part F, the contact image sensor 95 reads the second face of the original document MS while the original document MS is conveyed under the contact image sensor 95. After the images on both sides of the original document MS, the original document MS is conveyed in the document ejecting part G to be ejected toward the document stacking part H. In the document stacking part H, the document stacker 55 stacks the original documents MS.

The original document MS is positioned in the document setting part A with the leading end of the original document MS placed on the movable document table 53*a* serving as a sheet tray pivotable in the directions indicated by arrows "a" and "b" in FIG. 5 depending on the thicknesses of a bundle of the original documents MS and the trailing end of the original document MS placed on the document loading tray 53. At this time, the side guides of the document loading tray 53 contact both lateral side ends of the original document MS in the width direction (i.e., the direction orthogonal to the drawing sheet) to adjust the position of the original document MS in the width direction. The original documents MS thus set push up a lever 62 that is pivotably disposed above the movable document table 53*a*. Along with this movement of the original documents MS, the document set sensor 63 detects the setting of the original documents MS, and transmits the detection signal to the ADF controller 904 (see FIG. 7). The detection signal is then transmitted from the ADF controller 904 to the scanner controller 903 via the I/F.

The first document length sensor 57 and the second document length sensor 58 are held on the document loading tray 53. Each of the first document length sensor 57 and the second document length sensor 58 includes a reflective photosensor or an actuator-type sensor for detecting the length of the original document MS in the sheet conveyance direction. The length of the original document MS in the sheet conveyance direction is detected with the first document length sensor 57 and the second document length sensor 58.

The pickup roller 80 is supported by the cam mechanism to be movable in the vertical direction (i.e., the directions indicated by arrows "c" and "d" in FIG. 5) and is disposed above the bundle of original documents MS stacked on the movable document table 53*a*. The cam mechanism is driven by the pickup motor 56 to move the pickup roller 80 in the vertical direction. As the pickup roller 80 moves upward, the movable document table 53*a* rotates in the direction indicated by arrow "a" in FIG. 5, so that the pickup roller 80 is brought to contact the uppermost original document MS placed on top of the bundle of original documents MS. As the movable document table 53*a* further moves upward, a table lifting sensor 59 detects that the movable document table 53*a* moves up to the maximum height. In response to this detection, the pickup motor 56 stops driving to stop the movable document table 53*a* from moving up.

The apparatus control panel 902 including, for example, a numeric keypad and a display included in the housing of the copier 500 is operated by an operator to perform a key operation for setting a reading mode indicating a double-sided reading mode or a single-sided reading mode and a pressing operation of a copy start key. In other words, the apparatus control panel 902 functions as a mode information acquisition unit that acquires information indicating whether the reading mode is the double-sided reading mode or the single-sided reading mode. The reading mode includes a thin paper mode for reading thin paper and a mixed document mode in which original documents MS of different sizes are mixed and conveyed. The operator can set the thin paper mode or the mixed mode by the key operation on the apparatus control panel 902 by the operator. In the thin paper mode or the mixed document mode, the original document MS is conveyed at a conveyance speed of the original document MS totally slower than the normal reading mode.

As a copy start button 158 on the apparatus control panel 902 is pressed down, a document feeding signal is sent from an apparatus controller 901 to the ADF controller 904 of the ADF 51 via the I/F. In response to the sending of the document feeding signal, the pickup roller 80 is rotated along with the forward rotation of the sheet feeding motor 191, so that the original documents MS on the movable document table 53*a* are fed from the movable document table 53*a*.

The setting of the double-sided reading mode or the single-sided reading mode collectively covers the whole original documents MS stacked on the movable document table 53*a*. To be more specific, when the double-sided reading mode or the single-sided reading mode is set, both sides or a single-side of the whole original documents MS stacked on the movable document table 53*a* can be read.

In addition, individual reading mode setting can be performed on separate ones of the original documents MS. For example, the double-sided reading mode can be applied to the first and 10th original documents MS while the single-sided reading mode can be applied to the other original documents MS.

The original document MS fed by the pickup roller 80 enters the document separating and feeding part B to be fed to the contact position with the sheet feed belt 84. The sheet feed belt 84 is wound and stretched by a drive roller 82 and a driven roller 83 to be endlessly moved in the clockwise direction in FIG. 5 by rotation of the drive roller 82 along with the forward rotation of the sheet feeding motor 191. A separation roller 85 is in contact with the lower stretched face of the sheet feed belt 84 to be rotated in the clockwise direction in FIG. 5 along with the forward rotation of the sheet feeding motor 191. At the contact portion, the sheet feed belt 84 is rotated so that the surface of the sheet feed belt 84 moves in the sheet conveyance direction.

By contrast, the separation roller 85 is in contact with the sheet feed belt 84 with a given pressure. When the separation roller 85 directly contacts the sheet feed belt 84 or a single original document MS is nipped in the contact portion, the separation roller 85 is rotated with rotation of the sheet feed belt 84 or movement of the original document MS. However, when multiple original documents MS are nipped in the contact portion, the force of the separation roller 85 to be rotated with rotation of the sheet feed belt 84 or movement of the original document MS is lower than the torque of a torque limiter. For this reason, the separation roller 85 is rotated in the clockwise direction that is opposite to a direction in which the separation roller 85 is rotated. As a result, the separation roller 85 applies the force of movement in the direction opposite to the sheet conveyance direction, to the original documents MS under the uppermost original document MS, so that the uppermost original document MS is separated from the multiple original documents MS under the uppermost original document MS.

The original document MS is separated from the other original documents MS through the operations of the sheet feed belt 84 and the separation roller 85, and enters the registration part C. Then, the leading end of the original document MS is detected when the original document MS passes directly under the document contact sensor 72. At this time, the pickup roller 80 receiving the driving force of the sheet feeding motor 191 is still rotating. However, as the pickup roller 80 is separated from the original document MS due to descendance of the movable document table 53*a*, the original document MS is conveyed only by an endless moving force of the sheet feed belt 84. Then, the endless movement of the sheet feed belt 84 is continued for a given time from the timing at which the leading end of the original document MS is detected by the document contact sensor 72. Then, the leading end of the original document MS contacts the contact portion of the pullout driven roller 86 and the pullout drive roller 87 that rotates while contacting the pullout driven roller 86. While the leading end of the original document MS contacts the contact portion of the pullout driven roller 86 and the pullout drive roller 87, the trailing end of the original document MS is conveyed in the sheet conveyance direction. By so doing, the leading end of the original document MS is positioned at the contact portion while the original document MS is bent by a given amount. Accordingly, skew (inclination) of an original document MS is corrected, and the original document MS is positioned correctly in the sheet conveyance direction.

The pullout drive roller 87 has a function of correcting skew of the original document MS, and further has a function of conveying the original document MS after skew correction to an intermediate roller pair 66 disposed downstream from the pullout drive roller 87 in the sheet conveyance direction. When the drive roller 82, the pullout drive roller 87, and the drive roller of the intermediate roller pair 66 wind and stretch the pickup roller 80 and the sheet feed belt 84 and are coupled to the sheet feeding motor 191 via respective one-way clutches. The one-way clutches coupled to the pullout drive roller 87 and the drive roller of the intermediate roller pair 66 transmit the driving force when the sheet feeding motor 191 rotates in the reverse direction. The one-way clutch coupled to the drive roller 82 transmits the driving force when the sheet feeding motor 191 rotates in the forward direction. For this reason, when the sheet feeding motor 191 rotates in the reverse direction, the pullout drive roller 87 and the drive roller of the intermediate roller pair 66 start rotating and the endless movement of the sheet feed belt 84 stops. At this time, the pickup roller 80 stops rotating.

The original document MS that is fed by the pullout drive roller 87 passes directly under the document width sensor 73. The document width sensor 73 includes multiple document detectors each including a reflective photosensor. The multiple document detectors are aligned in a row in the width direction of the original document MS (i.e., the direction orthogonal to the drawing sheet of FIG. 5). The size of the original document MS in the width direction is detected based on which one of the multiple document detectors detects the original document MS. The length of the original document MS in the sheet conveyance direction is detected based on the time from when the leading end of the original document MS is detected by the document contact sensor 72 to when the trailing end of the original document MS is not detected by the document contact sensor 72.

The leading end of the original document MS whose size in the width direction is detected by the document width sensor 73 enters the document turning part D and is nipped by the contact portion between the rollers of the intermediate roller pair 66. The conveyance speed of the original document MS conveyed by the intermediate roller pair 66 is set faster than the conveyance speed of the original document MS in the first reading and conveying part E that will be described below. This configuration achieves a reduction in time for entering the original document MS to the first reading and conveying part E.

The leading end of the original document MS conveyed in the document turning part D passes through a position where the leading end of the original document MS faces the scan entrance sensor 67. As a result, when the leading end of the original document MS is detected by the scan entrance sensor 67, the document conveyance speed of the original document MS by the intermediate roller pair 66 is reduced until the leading end of the original document MS is conveyed to the position of the scan entrance roller pair (including rollers 89 and 90) downstream from the scan entrance sensor 67 in the sheet conveyance direction. As the sheet conveyance motor 192 starts to drive and rotate, one roller of the scan entrance roller pair (including the rollers 89 and 90), one roller of a first scan exit roller pair 92, and one roller of a second scan exit roller pair 93 respectively start rotation.

In the document turning part D, while the original document MS is conveyed in the curved conveyance passage between the intermediate roller pair 66 and the scan entrance roller pair (including the rollers 89 and 90), the upper and lower faces of the original document MS are reversed, and the conveyance direction of the original document MS is turned back. Then, the leading end of the original document MS that has passed through the nip region between the rollers (89 and 90) of the scan entrance roller pair passes directly under the registration sensor 65. When the registration sensor 65 detects the leading end of the original document MS, the conveyance speed of the original document MS is gradually decreased through the given conveyance distance. Then, before the first reading and conveying part E, the conveyance of the original document MS is temporarily stopped. Further, a temporary stop signal is sent to the scanner controller 903 (see FIG. 7) via the I/F.

After receiving the temporary stop signal, the scanner controller 903 sends a scanning start signal, the ADF controller 904 controls the sheet conveyance motor 192 resumes rotating to increase the conveyance speed of the original document MS up to the given conveyance speed until the leading end of the original document MS reaches the first reading and conveying part E. Then, at the timing at which the leading end of the original document MS reaches the reading position of the first fixed reading unit 151, the ADF controller 904 sends a gate signal indicating an effective image area of the first face of the original document MS in the sub-scanning direction, to the scanner controller 903. The ADF controller 904 continues sending the gate signal to the scanner controller 903 until the trailing end of the original document MS passes through the reading position of the first fixed reading unit 151, so that the first face of the original document MS is scanned by the first fixed reading unit 151. The timing at which the leading end of the original document MS reaches the reading position of the first fixed reading unit 151 is calculated based on the pulse count of the sheet conveyance motor 192. A left ruler 156 is disposed at a left corner of the second exposure glass 155. When scanning an original document MS, the original document MS is placed on the second exposure glass 155 by contacting at the scale of the left ruler 156 before being scanned.

The original document MS that has passed through the first reading and conveying part E passes through the first scan exit roller pair 92, which will be described below. Then, the leading end of the original document MS is detected by the document ejection sensor 61. When the single-sided reading mode is set, the second face of the original document MS is not to be read by the contact image sensor 95, which will be described below. As the leading end of the original document MS is detected by the document ejection sensor 61, the driving force of the sheet conveyance motor 192 is connected to a document ejection roller pair 94 by the sheet ejection clutch 194 to rotate the lower ejection roller in FIG. 5 of the document ejection roller pair 94 in the clockwise direction in FIG. 5. The timing at which the trailing end of the original document MS passes through the nip region of the document ejection roller pair 94 is calculated based on the pulse count of the sheet conveyance motor 192 after the detection of the leading end of the original document MS by the document ejection sensor 61. Then, based on this calculation result, the driving force of the sheet conveyance motor 192 is cut by the sheet ejection clutch 194 to stop the document ejection roller pair 94.

On the other hand, when the double-sided reading mode is set, the document ejection sensor 61 initially detects the leading end of the original document MS. Then, the timing at which the original document MS reaches the contact image sensor 95 is calculated based on the pulse count of the sheet conveyance motor 192. Then, at the timing at which the leading end of the original document MS reaches the contact image sensor 95, the ADF controller 904 sends a gate signal indicating the effective image area of the second face of the original document MS in the sub-scanning direction, to the scanner controller 903. The ADF controller 904 continues sending the gate signal to the scanner controller 903 until the trailing end of the original document MS passes through the reading position of the contact image sensor 95, so that the second face of the original document MS is scanned by the contact image sensor 95.

Then, the reading face of the contact image sensor 95 (CIS) serving as a second reader is coated for the purpose of preventing a reading vertical streak due to the paste-like foreign substance adhering to the original document MS adhering to the reading face of the contact image sensor 95. A reading roller 96 as a document supporter that supports the original document MS from a non-reading face side (i.e., the first face side) is disposed at a position facing the contact image sensor 95. The reading roller 96 serves as a floating retainer that prevents the original document MS from floating up at the reading position of the contact image sensor 95 and as a reference white portion for acquiring shading data in the contact image sensor 95. In the copier 500, the reading roller 96 is used as a document supporter that supports the original document MS at a position facing the contact image sensor 95. However, a member such as a guide plate may be used as a document supporter instead of the reading roller 96 having a roller shape.

A bundle of original documents MS bound by metal pieces such as staples and clips may be set on the document loading tray 53 due to user's carelessness. As the leading end of the bundle of original documents MS bound by the metal pieces such as staples and clips enter a separation part SP in which the leading end of the bundle of original documents MS contacts the sheet feed belt 84 of the separation roller 85, the uppermost original document MS placed on top of the bundle of original documents MS is continuously conveyed by the sheet feed belt 84. However, the second and subsequent original documents receive a conveyance force by the separation roller 85 to return the second and subsequent original documents MS to the document loading tray 53. As a result, the uppermost original document MS is distorted, and folded or wrinkled.

Typically, before the leading end of the original document MS is not detected by the document contact sensor 72 by a given timing and a paper jam is detected, the conveyance of the uppermost original document MS continues with the original document MS folded or wrinkled at the separation part SP. As a result, the uppermost original document MS is seriously wrinkled or folded, and eventually, a large stress is applied to the portion bound by the metal pieces, and the original document MS is torn, which may cause a large damage to the original document MS.

For this reason, in the present embodiment, the abnormal conveyance determination is performed to determine whether a paper jam occurs as abnormal conveyance from the sound in the sheet feeding and separating operation collected by the sound collection microphone 201 (in other words, to predict whether the document contact sensor 72 detects a paper jam). When it is determined that a paper jam is likely to occur, the conveyance of the original documents MS is stopped. Thus, conveyance of the original documents MS can be stopped before a paper jam is detected by the document contact sensor 72. As a result, conveyance of the original documents MS can be stopped before serious damage such as the tear of the original documents MS occurs on the original document MS.

As illustrated in FIG. 5, the sound collection microphone 201 is attached on the inner peripheral face of a sheet feeder cover 98 in an openable and closable manner. As the sound collection microphone 201 are disposed on the inner peripheral face of the sheet feeder cover 98, noise from outside the ADF 51 can be shut down by the sheet feeder cover 98 and the sound collection microphone 201 are made difficult to pick up noise from outside of the ADF 51. Alternatively, when disposing the sound collection microphone 201 on the inner circumferential face of the sheet feeder cover 98, a rubber vibration member may be disposed between the sound collection microphone 201 and the inner peripheral face of the sheet feeder cover 98, which can be made difficult to pick up noise due to vibration from the sheet feeder cover 98.

When the leading end of the bound bundle of original documents enters the separation part SP, the uppermost original document is deformed, in other words, is folded or wrinkled, due to stress at the bound portion. Such deformation including folding or wrinkling of the uppermost original document is caused in an area PA on the upstream side of the separation part SP in the document conveyance direction. For this reason, in the present embodiment, the sound collection microphone 201 is disposed upstream from the separation part SP in the document conveyance direction, to be more specific, above pickup roller 80, and between a pair of side fences when the pair of side fences is narrowest. The pair of side fences restricts the movement of the original document in a direction (document width direction) orthogonal to the document conveyance direction and one of the side fences is movable in the document width direction. As a result, the sound in the area PA upstream from the separation part SP in the document conveyance direction can be preferably collected, and the sound produced during the deformation of the uppermost original document in the area PA upstream from the separation part SP in the document conveyance direction can be preferably collected.

The position of the sound collection microphone 201 is not limited to the above-described configuration. For example, a sound collection microphone may be appropriately disposed at a position where no member that blocks the sound produced during the deformation of the uppermost original document on the upstream side of the separation part SP in the document conveyance direction and the sound in the area PA upstream from the separation part SP in the document conveyance direction can be preferably collected.

In addition, as illustrated in FIG. 6, the sound collection microphone 201 is disposed at the center position of the original document MS in the width direction with the intention of disposing the sound collection microphone 201 at a position where wrinkles or folds averagely occur on original documents MS of various widths.

To increase the productivity, it is preferable that the conveyance speed of the original document MS is relatively fast. However, when the conveyance speed is fast, noise such as vibration sound and motor sound increases. As a result, the sound produced during the deformation of an original document when an original document used to determine abnormal conveyance is folded or wrinkled is buried in the noise, and thus it is likely to lower the determination accuracy.

In order to address this inconvenience, in the present embodiment, the conveyance speed of the original document MS is slower than the normal conveyance speed while the sound collection microphone 201 is collecting sound.

A detailed description is now given of the ADF 51 according to the present embodiment, with reference to the drawings.

Figure 8:
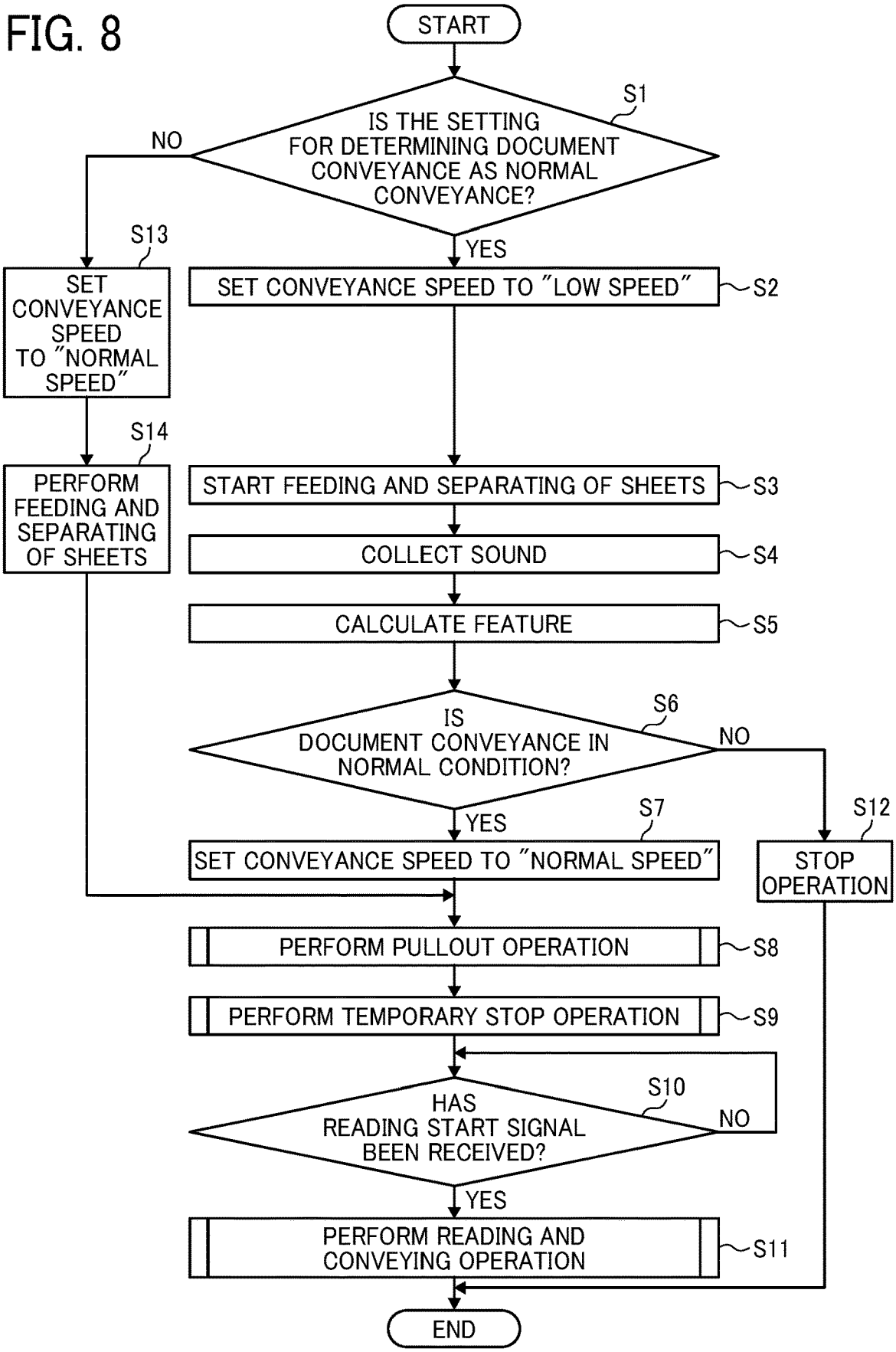
FIG. 8 is a flowchart of a process of document conveyance exerted by a controller.

FIG. 8 is a flowchart of the process of a document conveyance performed by the ADF controller 904.

In the present embodiment, conveyance of the original documents MS is continuously performed with an intervals between adjacent original documents MS to such an extent that the original documents MS as sheets do not overlap with each other in order to increase the throughput of reading. For this reason, multiple original documents MS are simultaneously present with the intervals between adjacent original documents MS in the original document conveyance passage. For this reason, the flow of the document conveyance illustrated in FIG. 8 is executed simultaneously in parallel.

In the present embodiment, whether to perform the abnormal conveyance determination can be selected by a key operation on the apparatus control panel 902 (see FIG. 7), and the setting information regarding whether to perform the abnormal conveyance determination is stored in a nonvolatile storage unit of the ADF controller 904.

As a document feeding signal is sent from the apparatus controller 901 to the ADF controller 904, the ADF controller 904 confirms the setting information regarding whether to perform the abnormal conveyance determination (step S1).

When the abnormal conveyance determination is set to be performed (YES in step S1), the conveyance speed is set to "low speed" (step S2) and the ADF controller 904 starts a feeding and separating operation (step S3).

The conveyance interval of original documents when the abnormal conveyance determination is set to be performed is greater than the conveyance interval of original documents when the abnormal conveyance determination is not set to be performed (referred to as a normal conveyance interval). The degree of the conveyance interval to be set greater than the normal conveyance interval is determined from a point of view that the driving noise of a motor and the conveyance sound of a preceding original document caused by conveyance of the preceding original document is prevented from occurring at a timing of collecting the sound of the subsequent original document or the influence of occurrence of the driving noise or the conveyance sound is reduced. For example, the feeding and separating operation on the subsequent original document is started at the timing when the operation of the sheet ejection clutch 194 is stopped, which is the timing when the trailing end of the preceding original document exits the nip region of the document ejection roller pair 94. As a result, the influence of the driving noise of the motor or the conveyance sound of the preceding original document caused by conveyance of the preceding original document can be completely eliminated.

Further, in a case where the original document MS has a size relatively short in the document conveyance direction and multiple preceding original documents can remain in the conveyance passage, the conveyance interval may be set such that only a single preceding original document exists on the document conveyance passage when collecting sound (during the feeding and separating operation of a subsequent original document). As a result, the influence of the conveyance sound of a preceding original document can be reduced. The length of the original document MS being conveyed in the document conveyance direction is detected by the first document length sensor 57 and the second document length sensor 58.

As the feeding and separating operation on the original document, the sheet feeding motor 191 rotates in the forward direction to drive and rotate the pickup roller 80 at a rotational speed slower than the "normal conveyance speed". Then, the original document MS placed on the movable document table 53*a* is fed out from the movable document table 53*a* to start conveyance of the original document MS at the conveyance speed slower than the normal conveyance speed. In the present embodiment, the conveyance speed of an original document is set to be half the normal conveyance speed. However, the conveyance speed of an original document is not limited to the above-described setting. For example, the conveyance speed of an original document may be appropriately determined depending on the configuration of a device (the degree of noise).

Simultaneously with the start of the conveyance of an original document, the ADF controller 904 causes the sound collection microphone 201 to start collecting sound at the feeding and separating operation (step S4). The sound collection microphone 201 stops collecting the sound at a timing at which the uppermost original document MS alone is separated from some other original documents MS in the separation part SP. Specifically, the sound collection microphone 201 stops collecting the sound at a timing at which the leading end of an original document MS slightly downstream from the separation part SP has passed through the separation part SP and the trailing end of the original document MS is upstream from the separation part SP in the document conveyance direction. Thus, the sound at the start of the occurrence of deformation such as a wrinkle or fold in the uppermost document can be collected, and conveyance of the original document MS can be stopped before the original document is seriously damaged, for example, the original document is terribly folded, wrinkled, or torn.

Further, as the sound collection microphone 201 starts collecting sounds simultaneously with the start of the conveyance of an original document, the slip sound of the pickup roller 80 can be collected. As a result, a delay of conveyance of an original document MS caused by slippage of the pickup roller 80 can be detected from the sound collected by the sound collection microphone 201. Accordingly, a paper jam due to such a delay of conveyance of an original document MS caused by slippage of the pickup roller 80 can be predicted.

The timing at which the sound collection microphone 201 stops collecting sound is determined based on, for example, the number of driving pulses of the sheet feeding motor 191 and the elapsed time from the start of driving the sheet feeding motor 191. The audio signal of the sounds collected by the sound collection microphone 201 is converted to pulse code modulation (PCM) data by an analog-to-digital (AD) converter in the ADF controller 904 and temporarily stored in the RAM of the ADF controller 904.

The ADF controller 904 then calculates the feature amount of the sound stored in the RAM (step S5). Specifically, the short-time Fourier transform (STFT) is performed on the audio signal of the sound stored in the RAM to calculate the time sequence of the power spectrum of the audio signal. The ADF controller 904 then performs a characterization process on the time sequence of the calculated power spectrum to calculate the feature amount of the sound. The characterization process may include, for example, time integration of power in a given frequency band and spectral flux between successive frames. In other words, in the present embodiment, the ADF controller 904 serves as a feature amount extraction unit. The feature amount that quantitatively describes the feature of the sound used for determining the operation condition is not limited to the above-described feature amount. For example, the feature amount may include known sound feature amounts such as Mel-Frequency Cepstral Coefficients.

In the present embodiment, while the sound collection microphone 201 is collecting sound, the conveyance speed of an original document is set to a "low conveyance speed" to convey the original document MS at a speed half the normal conveyance speed. By so doing, noise such as motor sound and vibration sound can be reduced when compared with conveyance of an original document at the normal conveyance speed. As a result, the sound at the start of deformation of an original document can be prevented from being buried in noise. Accordingly, the feature amount of sound at deformation of an original document (in conveyance of the original document at abnormal condition) and the feature amount of sound with no deformation of an original document (in conveyance of the original document at normal condition) can be different preferably. By so doing, an abnormal conveyance determination can be made accurately based on the extracted feature amount.

When the feature amount is calculated, the ADF controller 904 determines whether any abnormal conveyance occurs based on the calculated feature amount, in other words, whether the document conveyance is in a normal condition (step S6).

In the present embodiment, the abnormal conveyance determination is executed by the Mahalanobis Taguchi (MT) method. The MT method is one of Mahalanobis-Taguchi (MT) system known for prediction, diagnosis and analysis based on multidimensional information data in the field of, for example, quality engineering. The MT method is one of methods that can determine whether the data is normal or abnormal by using the Mahalanobis distance, and is a method that can determine whether the condition is normal or abnormal in a simple manner and with relatively high accuracy. A detailed description of the MT method is omitted as the MT method is a publicly known method described in, for example, Japanese Patent Application Laid-Open No. 2003-141306.

As index data used for the abnormal conveyance determination, the following data is stored in advance in the read only memory (ROM) of the ADF controller 904. In other words, the data includes an inverse matrix R−1 of the correlation matrix of a unit space data set (i.e., the reference data set) used when calculating the Mahalanobis distance and a threshold Th as criteria for classifying the calculated Mahalanobis distance into normal conveyance or abnormal conveyance.

The inverse matrix R−1 is obtained by creating a unit space data set (i.e., reference data set) based on a feature amount obtained from the sound in which the original document MS is successfully conveyed (normal conveyance) under various erroneous factor conditions in the ADF 51. The threshold Th as criteria for determining whether the calculated Mahalanobis distance is normal conveyance and abnormal conveyance is set by obtaining a Mahalanobis distance at which a false negative rate (erroneous determination rate of normal conveyance) and a false positive rate (erroneous determination rate of abnormal conveyance) of the ADF 51 are respective target values.

When the original document SM is deformed, in other words, when the document conveyance is in an abnormal condition, the calculated Mahalanobis distance exceeds the threshold Th and the ADF controller 904 determines that abnormal conveyance occurs (YES in step S6). When the ADF controller 904 determines that abnormal conveyance occurs, the ADF controller 904 stops the conveyance of the original document (document conveyance) (step S12) and stops reading the original document.

Then, the ADF controller 904 sends the result as a reading error to the apparatus control panel 902 of the image forming device 1 to display a message to, for example, prompt a paper jam handling.

The original document MS is conveyed from when the sound collection is stopped (at a timing at which the leading end of the original document MS is slightly downstream from the separation part SP in the document conveyance direction) to when the document conveyance is stopped in response to determination of the abnormal conveyance. However, since the original document is conveyed at the low conveyance speed in the present embodiment as described above, the original document is conveyed by a small conveyance distance between the timings. As a result, such a conveyance of an original document can be stopped before the trailing end of the original document has passed through the separation part SP, before serious damage such as terrible wrinkles, folds, or tears occur on the original document.

On the other hand, when the calculated Mahalanobis distance is equal to or smaller than the threshold Th and the ADF controller 904 determines that the document conveyance is normal conveyance (YES in step S6), the ADF controller 904 sets the conveyance speed of the original document from the "low conveyance speed" to the "normal conveyance speed" (step S7), and continues the conveyance of the original document. To be more specific, as described above, the ADF controller 904 causes the sheet feeding motor 191 to rotate in reverse, so that the pullout drive roller 87 pulls out the original document MS on which skew correction is performed. In other words, the ADF controller 904 performs a document pullout operation on the skew-corrected original document MS (step S8). Then, the ADF controller 904 causes the conveyance of the original document MS to temporarily stop before the first reading and conveying part E. In other words, the ADF controller 904 performs a temporary stop operation for temporarily stopping the conveyance of the original document MS before the original document MS enters the first reading and conveying part E (step S9). Then, the ADF controller 904 waits for a reading start signal to be sent from the scanner controller 903. In other words, the ADF controller 904 determined whether the reading start signal is received (step S10). When the ADF controller 904 determines that the reading start signal is received and starts reading the original document (YES in step S10), the ADF controller 904 resumes the conveyance of the original document to convey the original document to the first reading and conveying part E and the second reading and conveying part F, so as to perform a reading and conveying operation in which the image on the original document is read (step S11). Then, as the original document is conveyed to the document ejecting part G, the ADF controller 904 causes the original document to be ejected to the ejection tray and completes the reading of the original document.

On the other hand, when the setting for determining document conveyance is abnormal conveyance (NO in step S1), the conveyance speed of an original document is set to the "normal conveyance speed" that is faster than the "low conveyance speed" (step S13), and the feeding and separating operation is performed on the original document at the normal conveyance speed (step S14). The document conveyance interval is set to the minimum interval within a range in which the conveyance operation is established to maximize productivity.

In the present embodiment, the abnormal conveyance determination is executed using the MT method. However, the abnormal conveyance determination may be executed by classifying the feature amounts of the sounds into normal conveyance and abnormal conveyance through machine learning of, for example, support-vector machines. Multiple learned models are obtained as a result of machine learning based on the learned data including the feature amounts calculated from the sounds obtained in the feeding and separating operation (from the timing at which the conveyance of original documents is started to the timing at which the uppermost original document MS alone is separated from the other original documents MS at the separation part SP) and determined data (i.e., normal conveyance or abnormal conveyance) and are stored in the ROM of the ADF controller 904. The ADF controller 904 reads a corresponding learned model from the ROM, classifies the calculated feature amounts of the sounds into normal conveyance and abnormal conveyance using the read learned model, and executes the abnormal conveyance determination.

A sound collection microphone as a sound collector is disposed in at least one of the multiple conveyance parts including the registration part C, the document turning part D, the first reading and conveying part E, the second reading and conveying part F, or the document ejecting part G. Then, the sound collection microphone 201 may collect the sound when the original document passes near the sound collection microphone 201, and, based on the collected sound, the abnormal conveyance determination may be made at the conveyance part in which the original document is conveyed. In this case, by setting the document conveyance speed at the time at which the original document moves in the conveyance part, the sound produced during the deformation of the original document, for example, wrinkles in the original document, is prevented from being buried in noise. As a result, the ADF controller 904 can accurately determine whether abnormal conveyance occurs on an original document in the conveyance part based on the collected sound.

In the above-description, the ADF 51 is described as an applicable example of a sheet conveying device according to the present disclosure. However, the present disclosure may be applied to a sheet conveyance device that conveys a transfer sheet of the image forming device 1. For example, a sound collection microphone may be arranged so that the sound collection microphone can collect sound at a given position in, for example, an area from one of the sheet feed rollers 43 to a corresponding one of the sheet conveyance rollers 46 or an area from one of the sheet feed rollers 43 to the registration roller pair 33 serving as a pullout roller stoppable during conveyance of a transfer sheet. Then, sound is collected at the timing when the leading end of the transfer sheet passes the position to determine whether abnormal conveyance occurs based on the collected sound. By setting the conveyance speed of the transfer sheet to a low conveyance speed while the sound collection microphone is collecting the sound, the sound produced during the deformation such as wrinkles or folds of the transfer sheet can be preferably detected from the collected sound, resulting in accurate determination of abnormal conveyance. Further, the present disclosure may also be applied to the switchback device 36 or a sheet conveying device included in an inkjet image forming apparatus.

The above-described embodiments are illustrative and do not limit the present disclosure. Thus, numerous additional modifications and variations are possible in light of the above teachings. For example, elements and/or features of different illustrative embodiments may be combined with each other and/or substituted for each other within the scope of the present disclosure.

The configurations according to the above-descried embodiments are examples, and embodiments of the present disclosure are not limited to the above. For example, the following aspects can achieve effects described below.

Aspect 1

In Aspect 1, a sheet conveying device (for example, the ADF 51) includes a conveyor (for example, the pickup roller 80), a sound collector (for example, the sound collection microphone 201), and circuitry (for example, the ADF controller 904). The conveyor conveys a sheet (for example, the original document MS) in a sheet conveyance direction. The sound collector collects sound generated by a conveyance of the sheet. The circuitry is to determine whether a conveyance abnormal condition occurs based on the sound collected by the sound collector, and adjust a sheet conveyance speed when the sound collector is in operation of collecting the sound to perform determination of the conveyance abnormal condition to be slower than a sheet conveyance speed when the sound collector is not in operation of collecting the sound to perform determination of the conveyance abnormal condition.

To increase the productivity, it is preferable that the conveyance speed of a sheet is relatively fast. However, when the conveyance speed of a sheet is fast, noise that is not needed for determination of abnormal conveyance, such as vibration sound and motor sound, increases and sound that is needed for determination of abnormal conveyance, such as sound produced during the deformation of the sheet, is buried in the noise, and it is likely that determination accuracy in abnormal conveyance is impaired.

In order to address such an inconvenience, in Aspect 1, the conveyance speed of a sheet when the sound collector is in operation is slower than the conveyance speed of a sheet when the sound collector is not in operation, so as to prevent collection of relatively large noise. According to this configuration, sound at determination of abnormal conveyance can be prevented from being buried in noise, and the determination accuracy in abnormal conveyance can be prevented from being impaired.

Further, by reducing the conveyance speed of a sheet only when the sound collection is in operation, the sheet can be conveyed at a relatively high conveyance speed when the sound collection is not in operation. Accordingly, lowering the productivity can be minimized.

Aspect 2

In Aspect 2, according to Aspect 1, the sound collector (for example, the sound collection microphone 201) is disposed at a position at which the sound in a sheet conveyance passage (for example, the area PA) is collectable, and the circuitry (for example, the ADF controller 904) is to cause the sound collector to collect the sound to perform the determination of the abnormal conveyance condition when the sheet passes the sheet conveyance passage.

According to this configuration, as described in the embodiments above, the sound produced during the deformation of a sheet when the sheet is passing in the sheet conveyance passage (for example, the area PA) upstream from the separation part (for example, the separation part SP) in the sheet conveyance direction can be efficiently collected. Further, when a sheet is not passing in the sheet conveyance passage, the conveyance speed of the sheet can be increased, so that lowering the productivity can be minimized.

Aspect 3

In Aspect 3, the sheet conveying device (for example, the ADF 51) according to Aspect 2 further includes a setter (for example, the apparatus control panel 902) through which whether the circuitry (for example, the ADF controller 904) performs the determination of the abnormal conveyance condition is set. The circuitry is to adjust the sheet conveyance speed in the sheet conveyance passage (for example, the area PA) upstream from the separation part (for example, the separation part SP) in the sheet conveyance direction when the determination of the abnormal conveyance condition is not set through the setter to be faster than the sheet conveyance speed in the sheet conveyance passage when the determination of the abnormal conveyance condition is set through the setter.

According to this configuration, lowering the productivity when the abnormal conveyance determination is not performed can be reduced or prevented.

Aspect 4

In Aspect 4, the sheet conveying device (for example, the ADF 51) according to Aspect any one of Aspects 1 to 3 further includes a sheet tray (for example, the document loading tray 53), a sheet feeder (for example, the pickup roller 80), and a sheet separator (for example, the sheet feed belt 84, the separation roller 85). The sheet is placed on the sheet tray. The sheet feeder feeds the sheet. The sheet separator is in contact with the sheet feeder to separate the sheet from another sheet conveyed together with the sheet by the sheet feeder. The sheet feeder and the sheet separator form a separation part (for example, the separation part SP). The circuitry is to cause the sound collector to collect the sound to perform the determination of the abnormal conveyance condition from a start of feeding the sheet placed on the sheet tray to a timing at which a leading end of the sheet passes through the separation part.

According to this configuration, as described in the embodiments above, the sound produced during the deformation such as folds or wrinkles of the uppermost sheet when a sheet bundle of sheets bound by staples or clips is conveyed to the separation part can be collected. Accordingly, abnormal conveyance of the sheet is detected, and the conveyance of the sheet can be stopped before a relatively large stress is applied to a portion of the sheet bundle at the separation part to cause a significant damage such as tearing to the sheet.

Aspect 5

In Aspect 5, according to Aspect 4, the sound collector (for example, the sound collection microphone 201) is upstream from the separation part (for example, the separation part SP) in the sheet conveyance direction.

According to this configuration, as described in the embodiments above, the sound produced during the deformation such as folds or wrinkles of the uppermost sheet when a bundle of sheets bound by staples or clips is conveyed to the separation part can be preferably collected.

Aspect 6

In Aspect 6, the sheet conveying device (for example, the ADF 51) according to any one of Aspects 1 to 5 further includes a setter (for example, the apparatus control panel 902) through which whether the circuitry (for example, the ADF controller 904) performs the determination of the abnormal conveyance condition is set. The circuitry is to adjust the sheet conveyance speed when the sound collector is in operation of collecting the sound to perform determination of the abnormal conveyance condition as set through the setter, to be equal to the sheet conveyance speed when the determination of the conveyance abnormal condition is not performed as set through the setter.

According to this configuration, lowering the productivity can be prevented in comparison with a configuration in which the sheet conveyance speed when the sound collector in the setting, through the setter, that the abnormal conveyance determination is performed does not collect sound for the abnormal conveyance determination is slower than the sheet conveyance speed in the setting, through the setter, that the abnormal conveyance determination is not performed.

Aspect 7

In Aspect 7, the sheet conveying device (for example, the ADF 51) according to any one of Aspects 1 to 6 further includes a setter (for example, the apparatus control panel 902) through which whether the circuitry (for example, the ADF controller 904) performs the determination of the abnormal conveyance condition is set. The circuitry is to adjust a sheet conveyance interval when the determination of the conveyance abnormal condition is set through the setter, to be greater than a sheet conveyance interval when the determination of the conveyance abnormal condition is not set through the setter.

According to this configuration, as described in the embodiments above, this configuration can achieve the following effect when compared with a configuration in which the sheet conveyance interval in the setting that the determination of the abnormal conveyance is performed is equal to the sheet conveyance interval in the setting that the determination of the abnormal conveyance is not performed. In other words, this configuration can prevent the sound produced during the deformation of a sheet needed for the abnormal conveyance determination from being buried due to the conveyance sound of the preceding sheet or the driving sound of a motor along the conveyance of the preceding sheet, and can perform a highly accurate abnormal conveyance determination.

Aspect 8

In Aspect 8, an automatic document feeder (for example, the ADF 51) includes the sheet conveying device (for example, the ADF 51) according to any one of Aspects 1 to 7 to convey an original document (for example, the original document MS) to an image reader (for example, the scanner 150).

According to this configuration, relatively significant damage to a document sheet (for example, the original document MS), such as tearing of the sheet, can be prevented.

Aspect 9

In Aspect 9, an image forming apparatus (for example, the copier 500) includes the sheet conveyance device (for example, the ADF 51) according to any one of Aspects 1 to 7 or the automatic document feeder (for example, the ADF 51) according to Aspect 8.

According to this configuration, relatively significant damage on a sheet or damage on a document sheet can be forestalled.

Aspect 10

In Aspect 10, a sheet conveying device (for example, the ADF 51) includes a conveyor (for example, the pickup roller 80), a sound collector (for example, the sound collection microphone 201), and circuitry (for example, the ADF controller 904). The conveyor conveys a sheet (for example, the original document MS) in a sheet conveyance direction. The sound collector collects sound produced by the conveyor during a conveyance of the sheet. The circuitry is to cause the sound collector to collect the sound in an abnormal determination operation, determine whether an abnormal conveyance occurs based on the sound collected by the sound collector in the abnormal determination operation, cause the conveyor to convey the sheet at a first speed in the sheet conveyance direction in a normal conveyance operation, and cause the conveyor to convey the sheet at a second speed slower than the first speed in the sheet conveyance direction in the abnormal determination operation.

Aspect 11

In Aspect 11, the sheet conveying device (for example, the ADF 51) according to Aspect 10 further includes a sheet conveyance passage (for example, the area PA) along which the sheet is conveyed in the sheet conveyance direction, and a separating part (for example, the separating part SP) in the sheet conveyance passage to separate the sheet one by one from bundle of sheets. The sound collector (for example, the sound collection microphone 201) is upstream of the separating part in the sheet conveyance direction and adjacent to the conveyor. The circuitry (for example, the ADF controller 904) is further to cause the sound collector to collect the sound in response to a passage of the sheet through the sheet conveyance passage in the abnormal determination operation.

Aspect 12

In Aspect 12, the sheet conveying device (for example, the ADF 51) according to Aspect 11 further includes a control panel (for example, the control panel 902) by which the circuitry (for example, the ADF controller 904) is set to one of the normal conveyance operation and the abnormal detection operation. The circuitry is further to cause the conveyor to convey the sheet at the first speed in the normal conveyance operation to be faster than the second speed in the abnormal determination operation.

Aspect 13

In Aspect 13, the sheet conveying device according to any one of Aspects 10 to 12 further includes a sheet tray (for example, the document loading tray 53), a sheet feeder (for example, the pickup roller 80), and a sheet separator (for example, the sheet feed belt 84, the separation roller 85). The sheet is placed on the sheet tray. The sheet feeder feeds the sheet. The sheet separator separates the sheet from another sheet, conveyed together with the sheet by the sheet feeder, at a separation part (for example, the separation part SP). The circuitry (for example, the ADF controller 904) is configured to cause the sound collector to collect the sound, and determine whether the abnormal conveyance occurs from a start of feeding the sheet placed on the sheet tray to a timing at which a leading end of the sheet passes through the separation part.

Aspect 14

In Aspect 14, according to Aspect 13, the sound collector (for example, the sound collection microphone 201) is upstream from the separation part (for example, the separation part SP) in the sheet conveyance direction.

Aspect 15

In Aspect 15, the sheet conveying device (for example, the ADF 51) according to any one of Aspects 10 to 14 further includes a control panel (for example, the apparatus control panel 902) by which the circuitry (for example, the ADF controller 904) is set to one of the normal conveyance operation and the abnormal detection operation. The circuitry is further to cause the conveyor to convey the sheet at a third speed equal to the first speed when the sound collector does not collect the sound in the abnormal detection operation.

Aspect 16

In Aspect 16, the sheet conveying device (for example, the ADF 51) according to any one of Aspects 10 to 15 further includes a control panel (for example, the apparatus control panel 902) by which the circuitry (for example, the ADF controller 904) is set to one of the normal conveyance operation and the abnormal detection operation. The conveyor conveys multiple sheets including the sheet in the sheet conveyance direction. The circuitry is further to cause the conveyor to convey the multiple sheets at a first sheet conveyance interval between the multiple sheets in the normal conveyance operation, and cause the conveyor to convey the multiple sheets at a second sheet conveyance interval greater than the first sheet conveyance interval in the abnormal detection operation.

Aspect 17

In Aspect 17, an image forming apparatus (for example, the copier 500) includes the sheet conveying device (for example, the ADF 51) according to any one of Aspects 10 to 16 to convey the sheet (for example, the original document MS), and an image forming device (for example, the image forming device 1) to form an image on a recording medium conveyed by the sheet conveying device.

Aspect 18

In Aspect 18, an automatic document feeder (for example, the ADF 51) includes the sheet conveying device (for example, the ADF 51) according to any one of Aspects 10 to 16 to automatically convey an original document as the sheet to an image reader (for example, the scanner 150).

Aspect 19

In Aspect 19, an image forming apparatus (for example, the copier 500) includes the automatic document feeder (for example, the ADF 51) according to Aspect 18, and an image forming device (for example, the image forming device 1) to form an image on a recording medium.

The present disclosure is not limited to specific embodiments described above, and numerous additional modifications and variations are possible in light of the teachings within the technical scope of the appended claims. It is therefore to be understood that, the disclosure of this patent specification may be practiced otherwise by those skilled in the art than as specifically described herein, and such, modifications, alternatives are within the technical scope of the appended claims. Such embodiments and variations thereof are included in the scope and gist of the embodiments of the present disclosure and are included in the embodiments described in claims and the equivalent scope thereof.

The effects described in the embodiments of this disclosure are listed as the examples of preferable effects derived from this disclosure, and therefore are not intended to limit to the embodiments of this disclosure.

The embodiments described above are presented as an example to implement this disclosure. The embodiments described above are not intended to limit the scope of the invention. These novel embodiments can be implemented in various other forms, and various omissions, replacements, or changes can be made without departing from the gist of the invention. These embodiments and their variations are included in the scope and gist of this disclosure and are included in the scope of the invention recited in the claims and its equivalent.

Any one of the above-described operations may be performed in various other ways, for example, in an order different from the one described above.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA), and conventional circuit components arranged to perform the recited functions.

What is claimed is:

1. A sheet conveying device comprising:

a conveyor to convey a sheet in a sheet conveyance direction;

a sheet separator to separate, at a separation part, the sheet from another sheet conveyed together with the sheet;

a sound collector to collect sound produced by the conveyor during a conveyance of the sheet; and circuitry configured to:

cause the sound collector to collect the sound in an abnormal determination operation;

determine whether an abnormal conveyance occurs based on the sound collected by the sound collector in the abnormal determination operation;

determine whether the abnormal conveyance occurs at a time from a start timing of feeding the sheet to a time at which a leading end of the sheet passes through the separation part;

cause the conveyor to convey the sheet at a first speed in the sheet conveyance direction in a normal conveyance operation; and cause the conveyor to convey the sheet at a second speed slower than the first speed in the sheet conveyance direction in the abnormal determination operation.

2. The sheet conveying device according to claim 1, further comprising:

a sheet conveyance passage along which the sheet is conveyed in the sheet conveyance direction, wherein the separating part is in the sheet conveyance passage to separate the sheet one by one from a bundle of sheets, wherein the sound collector is upstream of the separating part in the sheet conveyance direction and adjacent to the conveyor, and the circuitry is further configured to cause the sound collector to collect the sound in response to a passage of the sheet through the sheet conveyance passage in the abnormal determination operation.

3. The sheet conveying device according to claim 2, further comprising a control panel by which the circuitry is set to one of the normal conveyance operation and the abnormal determination operation, wherein the circuitry is further configured to cause the conveyor to convey the sheet at the first speed in the normal conveyance operation to be faster than the second speed in the abnormal determination operation.

4. The sheet conveying device according to claim 1, further comprising:

a sheet tray on which the sheet is placed; and a sheet feeder to feed the sheet.

5. The sheet conveying device according to claim 4, wherein the sound collector is upstream from the separation part in the sheet conveyance direction.

6. The sheet conveying device according to claim 1, further comprising a control panel by which the circuitry is set to one of the normal conveyance operation and the abnormal determination operation, wherein the circuitry is further configured to cause the conveyor to convey the sheet at a third speed equal to the first speed when the sound collector does not collect the sound in the abnormal determination operation.

7. The sheet conveying device according to claim 1, further comprising a control panel by which the circuitry is set to one of the normal conveyance operation and the abnormal determination operation, wherein the conveyor conveys multiple sheets including the sheet in the sheet conveyance direction, and the circuitry is further configured to:

cause the conveyor to convey the multiple sheets at a first sheet conveyance interval between the multiple sheets in the normal determination operation; and cause the conveyor to convey the multiple sheets at a second sheet conveyance interval greater than the first sheet conveyance interval in the abnormal determination operation.

8. An image forming apparatus comprising:

the sheet conveying device according to claim 1 to convey the sheet; and an image forming device to form an image on the sheet conveyed by the sheet conveying device.

9. An automatic document feeder comprising the sheet conveying device according to claim 1 to automatically convey an original document as the sheet to an image reader.

10. An image forming apparatus comprising:

the automatic document feeder according to claim 9; and an image forming device to form an image on a recording medium.

11. A sheet conveying device comprising:

a conveyor to convey a sheet in a sheet conveyance direction;

a sound collector to collect sound produced by the conveyor during a conveyance of the sheet;

circuitry configured to:

cause the sound collector to collect the sound in an abnormal determination operation;

determine whether an abnormal conveyance occurs based on the sound collected by the sound collector in the abnormal determination operation;

cause the conveyor to convey the sheet at a first speed in the sheet conveyance direction in a normal conveyance operation; and cause the conveyor to convey the sheet at a second speed slower than the first speed in the sheet conveyance direction in the abnormal determination operation; and a control panel by which the circuitry is set to one of the normal conveyance operation and the abnormal determination operation, wherein the circuitry is further configured to cause the conveyor to convey the sheet at a third speed equal to the first speed when the sound collector does not collect the sound in the abnormal determination operation.

12. An image forming apparatus comprising:

the sheet conveying device according to claim 11 to convey the sheet; and an image forming device to form an image on the sheet conveyed by the sheet conveying device.

13. An automatic document feeder comprising the sheet conveying device according to claim 11 to automatically convey an original document as the sheet to an image reader.

14. An image forming apparatus comprising:

the automatic document feeder according to claim 13; and an image forming device to form an image on a recording medium.

15. A sheet conveying device comprising:

a conveyor to convey a sheet in a sheet conveyance direction;

a sound collector to collect sound produced by the conveyor during a conveyance of the sheet; and circuitry configured to:

cause the sound collector to collect the sound in an abnormal determination operation;

determine whether an abnormal conveyance occurs based on the sound collected by the sound collector in the abnormal determination operation;

cause the conveyor to convey the sheet at a first speed in the sheet conveyance direction in a normal conveyance operation; and cause the conveyor to convey the sheet at a second speed slower than the first speed in the sheet conveyance direction in the abnormal determination operation;

a sheet conveyance passage along which the sheet is conveyed in the sheet conveyance direction; and a separating part in the sheet conveyance passage to separate the sheet one by one from a bundle of sheets, wherein the sound collector is upstream of the separating part in the sheet conveyance direction and adjacent to the conveyor, and the circuitry is further configured to cause the sound collector to collect the sound in response to a passage of the sheet through the sheet conveyance passage in the abnormal determination operation.

16. An image forming apparatus comprising:

the sheet conveying device according to claim 15 to convey the sheet; and an image forming device to form an image on the sheet conveyed by the sheet conveying device.

17. An automatic document feeder comprising the sheet conveying device according to claim 15 to automatically convey an original document as the sheet to an image reader.

18. An image forming apparatus comprising:

the automatic document feeder according to claim 17; and an image forming device to form an image on a recording medium.

* * * * *